US010865609B2

(12) United States Patent
Orr et al.

(10) Patent No.: US 10,865,609 B2
(45) Date of Patent: Dec. 15, 2020

(54) HIGH TRIP RATE DRILLING RIG

(71) Applicant: SCHLUMBERGER TECHNOLOGY CORPORATION, Sugar Land, TX (US)

(72) Inventors: Melvin Alan Orr, Tulsa, OK (US); Mark W. Trevithick, Cypress, TX (US); Joe Rodeny Berry, Cypress, TX (US); Robert W. Metz, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/722,156

(22) Filed: Dec. 20, 2019

(65) Prior Publication Data

US 2020/0123860 A1 Apr. 23, 2020

Related U.S. Application Data

(63) Continuation of application No. 15/631,115, filed on Jun. 23, 2017, now Pat. No. 10,550,650, which is a (Continued)

(51) Int. Cl.
*E21B 19/14* (2006.01)
*E21B 3/02* (2006.01)
(Continued)

(52) U.S. Cl.
CPC ..... *E21B 19/14* (2013.01); *E21B 3/02* (2013.01); *E21B 15/00* (2013.01); *E21B 19/06* (2013.01);
(Continued)

(58) Field of Classification Search
CPC ..... E21B 3/02; E21B 19/14; E21B 19/16
See application file for complete search history.

(56) References Cited

U.S. PATENT DOCUMENTS 2,412,020 A 12/1946 Walters
3,253,995 A 5/1966 Antonsen
(Continued)

FOREIGN PATENT DOCUMENTS

CN 104563912 A 4/2015
EP 0979924 A2 2/2000
(Continued)

*Primary Examiner* — Shane Bomar
(74) *Attorney, Agent, or Firm* — Rachel E. Greene

(57) ABSTRACT

A drilling rig system for obtaining high trip rates separates the transport of tubular stands in and out of their setback position into a first function, delivery and retrieval of tubular stands in well center position as a second function; and the functions intersect at a stand hand-off position where tubular stands are set down for exchange between tubular handling equipment. A drilling rig has a tubular delivery arm that vertically translates the mast in a non-conflicting path with a top drive. The tubular delivery arm is operable to deliver tubular stands between a catwalk, stand hand-off, mouse-hole, and/or well center positions. An upper racking arm moves tubular stands between a racked position in the racking module and a stand hand-off position between the mast and racking module. An upper support constraint stabilizes tubular stands at the stand hand-off position.

40 Claims, 35 Drawing Sheets

Related U.S. Application Data continuation of application No. PCT/US2016/062402, filed on Nov. 17, 2016, and a continuation of application No. 15/353,798, filed on Nov. 17, 2016, now Pat. No. 10,519,727.

(60) Provisional application No. 62/330,244, filed on May 1, 2016, provisional application No. 62/256,586, filed on Nov. 17, 2015.

(51) Int. Cl.

| | |
|---|---|
| ***E21B 19/16*** | (2006.01) |
| ***E21B 19/24*** | (2006.01) |
| ***E21B 15/00*** | (2006.01) |
| ***E21B 19/06*** | (2006.01) |
| ***E21B 19/20*** | (2006.01) |

(52) U.S. Cl.

CPC ..... *E21B 19/16* (2013.01); *E21B 19/20* (2013.01); *E21B 19/24* (2013.01)

(56) References Cited

U.S. PATENT DOCUMENTS

| | | | |
|---|---|---|---|
| 3,874,518 | A | 4/1975 | Swoboda, Jr. et al. |
| 4,042,123 | A | 8/1977 | Sheldon et al. |
| 4,274,778 | A | 6/1981 | Putnam et al. |
| 4,348,920 | A | 9/1982 | Boyadjieff |
| 4,421,179 | A | 12/1983 | Boyadjieff |
| 4,462,733 | A | 7/1984 | Langowski et al. |
| 4,501,522 | A | 2/1985 | Causer et al. |
| 4,610,315 | A | 9/1986 | Koga et al. |
| 4,621,974 | A | 11/1986 | Krueger |
| 4,715,761 | A | 12/1987 | Berry et al. |
| 4,738,321 | A | 4/1988 | Olivier |
| 4,850,439 | A | 7/1989 | Lund |
| 5,038,871 | A | 8/1991 | Dinsdale |
| 5,107,940 | A | 4/1992 | Berry |
| 5,211,251 | A | 5/1993 | Woolslayer |
| 5,423,390 | A | 6/1995 | Donnally et al. |
| 6,220,807 | B1 | 4/2001 | Sorokan |
| 6,513,605 | B1 | 2/2003 | Lodden |
| 6,557,651 | B1 | 5/2003 | Norby et al. |
| 6,591,471 | B1 | 7/2003 | Hollingsworth et al. |
| 6,591,904 | B2 | 7/2003 | Cicognani |
| 6,609,565 | B1 | 8/2003 | Andreychuk et al. |
| 6,748,823 | B2 | 6/2004 | Pietras |
| 6,779,614 | B2 | 8/2004 | Oser |
| 6,821,071 | B2 | 11/2004 | Woolslayer et al. |
| 6,860,337 | B1 | 3/2005 | Orr et al. |
| 6,976,540 | B2 | 12/2005 | Berry |
| 6,997,265 | B2 | 2/2006 | Berry |
| 7,043,814 | B2 | 5/2006 | Hollingsworth et al. |
| 7,114,235 | B2 | 10/2006 | Jansch et al. |
| 7,140,445 | B2 | 11/2006 | Shahin et al. |
| 7,219,744 | B2 | 5/2007 | Pietras |
| 7,246,983 | B2 | 7/2007 | Zahn et al. |
| 7,331,746 | B2 | 2/2008 | Wright et al. |
| 7,353,880 | B2 | 4/2008 | Pietras |
| 7,451,826 | B2 | 11/2008 | Pietras |
| 7,677,856 | B2 | 3/2010 | Standal |
| 7,681,632 | B2 | 3/2010 | Wood |
| 7,699,122 | B2 | 4/2010 | Eriksen |
| 7,794,192 | B2 | 9/2010 | Wright et al. |
| 7,802,636 | B2 | 9/2010 | Childers et al. |
| 7,828,085 | B2 | 11/2010 | Kuttel et al. |
| 7,931,077 | B2 | 4/2011 | Rudshaug et al. |
| 8,028,748 | B2 | 10/2011 | Laitolais, Jr. et al. |
| 8,052,370 | B2 | 11/2011 | Dekker et al. |
| 8,186,455 | B2 | 5/2012 | Childers et al. |
| 8,186,925 | B2 | 5/2012 | Littlely |
| 8,186,926 | B2 | 5/2012 | Littlely |
| 8,215,887 | B2 | 7/2012 | Fikowski et al. |
| 8,317,448 | B2 | 11/2012 | Hankins et al. |
| 8,397,837 | B2 | 3/2013 | Skogerbo |
| 8,550,761 | B2 | 10/2013 | Belik et al. |
| 8,584,773 | B2 | 11/2013 | Childers et al. |
| 8,839,881 | B1 | 9/2014 | Baumler |
| 8,839,884 | B2 | 9/2014 | Kuttel et al. |
| 8,910,719 | B2 | 12/2014 | Kockeis et al. |
| 8,949,416 | B1 | 2/2015 | Barnes et al. |
| 8,961,093 | B2 | 2/2015 | Springett et al. |
| 8,992,152 | B2 | 3/2015 | Nouwens et al. |
| 9,010,410 | B2 | 4/2015 | Story |
| 9,562,407 | B2 | 2/2017 | Magnuson |
| 9,624,739 | B2 | 4/2017 | Kannegaard et al. |
| 10,053,934 | B2 | 8/2018 | Keogh et al. |
| 2004/0069532 | A1 | 4/2004 | Keast |
| 2005/0173154 | A1 | 8/2005 | Lesko |
| 2006/0104747 | A1 | 5/2006 | Zahn et al. |
| 2007/0193750 | A1 | 8/2007 | Wright et al. |
| 2008/0164064 | A1 | 7/2008 | Belik et al. |
| 2008/0302525 | A1 | 12/2008 | Beierbach et al. |
| 2009/0053015 | A1 | 2/2009 | Zachariasen et al. |
| 2009/0274545 | A1 | 11/2009 | Liess et al. |
| 2010/0243325 | A1 | 9/2010 | Veeningen |
| 2010/0303586 | A1 | 12/2010 | Hankins et al. |
| 2010/0326672 | A1 | 12/2010 | Childers et al. |
| 2011/0079434 | A1 | 4/2011 | Belik et al. |
| 2011/0174483 | A1 | 7/2011 | Odell et al. |
| 2012/0020758 | A1 | 1/2012 | Springett et al. |
| 2012/0067642 | A1 | 3/2012 | Magnuson |
| 2012/0305261 | A1 | 12/2012 | Roodenburg et al. |
| 2013/0025937 | A1 | 1/2013 | Pilgrim et al. |
| 2013/0112395 | A1 | 5/2013 | Story |
| 2013/0220601 | A1 | 8/2013 | Ferrari |
| 2013/0284450 | A1 | 10/2013 | Roodenburg et al. |
| 2014/0110174 | A1 | 4/2014 | Childers et al. |
| 2014/0124218 | A1 | 5/2014 | Pilgrim |
| 2014/0202769 | A1 | 7/2014 | Magnuson |
| 2014/0328650 | A1 | 11/2014 | Hu |
| 2016/0060979 | A1 | 3/2016 | Magnuson |
| 2017/0234088 | A1 | 8/2017 | Orr et al. |
| 2018/0216405 | A1 | 8/2018 | De Mul et al. |
| 2018/0328112 | A1 | 11/2018 | Berry et al. |
| 2019/0017334 | A1 | 1/2019 | Loeyning et al. |
| 2019/0106950 | A1 | 4/2019 | Alvaer et al. |

FOREIGN PATENT DOCUMENTS

| | | | |
|---|---|---|---|
| RU | 2018617 | C1 | 8/1994 |
| RU | 2100565 | C1 | 12/1997 |
| RU | 2541972 | C2 | 2/2015 |
| SU | 1730422 | A1 | 4/1992 |
| WO | 9315303 | A1 | 8/1993 |
| WO | 0111181 | A1 | 2/2001 |
| WO | 0218742 | A1 | 3/2002 |
| WO | 2006059910 | A1 | 6/2006 |
| WO | 2010141231 | A2 | 12/2010 |
| WO | 2011016719 | A1 | 2/2011 |
| WO | 2011056711 | A2 | 5/2011 |
| WO | 2012148286 | A1 | 11/2012 |
| WO | 2014029812 | A2 | 2/2014 |
| WO | 2016204608 | A1 | 12/2016 |
| WO | 2017087200 | A1 | 5/2017 |
| WO | 2017087349 | A1 | 5/2017 |
| WO | 2017087350 | A1 | 5/2017 |

HIGH TRIP RATE DRILLING RIG

CROSS-REFERENCE TO RELATED APPLICATION

The present document is a continuation application of U.S. patent application Ser. No. 15/631,115, filed Jun. 23, 2017, which is a continuation application of International Application Number PCT/US2016/062402, filed Nov. 17, 2016, and U.S. Non-Provisional application Ser. No. 15/353,798, filed Nov. 17, 2016. Both applications filed Nov. 17, 2016 claim the benefit of and priority to U.S. Provisional Application Ser. No. 62/330,244, filed May 1, 2016, and U.S. Provisional Application Ser. No. 62/256,586, filed Nov. 17, 2015. All five of these applications are incorporated herein by reference in their entireties.

BACKGROUND

In the exploration of oil, gas and geothermal energy, drilling operations are used to create boreholes, or wells, in the earth. Conventional drilling involves having a drill bit on the bottom of the well. A bottom-hole assembly is located immediately above the drill bit where directional sensors and communications equipment, batteries, mud motors, and stabilizing equipment are provided to help guide the drill bit to the desired subterranean target.

A set of drill collars are located above the bottom-hole assembly to provide a non-collapsible source of weight to help the drill bit crush the formation. Heavy weight drill pipe is located immediately above the drill collars for safety. The remainder of the drill string is mostly drill pipe, designed to operate under tension. A conventional drill pipe section is about 30 feet long, but lengths vary based on style. It is common to store lengths of drill pipe in "doubles" (2 connected lengths) or "triples" (3 connected lengths). When the drill string (drill pipe, drill collars and other components) are removed from the wellbore to change-out the worn drill bit, the drill pipe and drill collars are set back in doubles or triples until the drill bit is retrieved and exchanged. This process of pulling everything out of the hole and running it all back in is known as "tripping."

Tripping is non-drilling time and, therefore, an expense. Efforts have long been made to devise ways to avoid it or at least speed it up. Running triples is faster than running doubles because it reduces the number of threaded connections to be disconnected and then reconnected. Triples are longer and therefore more difficult to handle due to their length and weight and the natural waveforms that occur when moving them around. Manually handling moving pipe can be dangerous.

It is desirable to have a drilling rig with the capability to reduce the trip time. One option is to operate a pair of opposing masts, each equipped with a fully operational top drive that sequentially swings over the wellbore. In this manner, tripping can be nearly continuous, pausing only to spin connections together or apart. Problems with this drilling rig configuration include at least costs of equipment, operation and transportation.

Tripping is a notoriously dangerous activity. Conventional drilling practice requires locating a derrickman high up on the racking module platform, where he is at risk of a serious fall and other injuries common to manually manipulating the heavy pipe stands when racking and unracking the pipe stands when tripping. Personnel on the drill floor are also at risk, trying to manage the vibrating tail of the pipe stand, often covered in mud and grease of a slippery drill floor in inclement weather. In addition, the faster desired trip rates increase risks.

It is desirable to have a drilling rig with the capability to reduce trip time and connection time. It is also desirable to have a system that includes redundancies, such that if a component of the system fails or requires servicing, the task performed by that component can be taken-up by another component on the drilling rig. It is also desirable to have a drilling rig that has these features and remains highly transportable between drilling locations.

SUMMARY

A drilling rig system is disclosed for obtaining high trip rates, particularly on land based, transportable drilling rigs. The drilling rig minimizes non-productive time by separating the transport of tubular stands in and out of their setback position into a first function and delivery of a tubular stand to well center as a second function. The functions intersect at a stand hand-off position, where tubular stands are set down for exchange between tubular handling equipment. The various embodiments of the drilling rig system may include one or more of the following components:

1) Top Drive, or Retractable Top Drive
2) Tubular Delivery Arm
3) Racking Module
4) Upper Racking Arm
5) Setback Platform
6) Lower racking arm
7) Stand Hand-off Position
8) Stand Hand-off Station
9) Lower Stabilizing Arm
10) Upper Stand Constraint
11) Intermediate Stand Constraint
12) Lower Stand Constraint The various embodiments of the new drilling rig system also include methods for stand building and tripping in and tripping out.

It is understood that certain of the above listed components may be omitted, or are optional or may be replaced with similar devices that may otherwise accomplish the designated purpose. These replacements or omissions may be done without departing from the spirit and teachings of the present disclosure.

In one embodiment, a retractable top drive vertically translates the drilling mast. The retractable top drive travels vertically along either of, or between, two vertical centerlines; the well centerline and a retracted centerline.

In embodiments, a tubular delivery arm travels vertically along the structure of the same drilling mast, and may have a lifting capability less than that of the top drive, e.g., limited generally to that of a tubular stand of drill pipe or drill collars. The tubular delivery arm can move tubular stands vertically and horizontally in the drawworks to V-door direction and back, reaching positions that may include the centerline of the wellbore, a stand hand-off position, a mousehole, and a catwalk.

In embodiments, the stand hand-off position is a designated setdown position for transferring the next tubular stand to go into the well, as handled between the tubular delivery arm and the top drive. The stand hand-off position may also be the designated setdown position for transferring the next tubular stand to be racked, as handled between the tubular delivery arm and an upper racking arm. In one embodiment, the lower end of the stand hand-off position is located on a setback platform beneath the drill floor where a lower racking arm works with the upper racking arm.

In embodiments, the upper racking arm can be provided to move tubular stands of drilling tubulars between any racking position within the racking module and the stand hand-off position, located between the mast and racking module.

In embodiments, an upper stand constraint may be provided to clasp a tubular stand near its top to secure it in vertical orientation when at the stand hand-off position. The upper stand constraint may be mounted on the racking module. By securing an upper portion of a tubular stand at the stand hand-off position, the upper racking arm is free to progress towards the next tubular stand in the racking module. The tubular delivery arm can clasp the tubular stand above the upper stand constraint without interfering with the path of the upper racking arm. The tubular delivery arm lowers to clasp the tubular stand held by the upper stand constraint.

In embodiments, a setback platform is provided beneath the racking module for supporting stored casing and tubular stands. The setback platform is near ground level. A lower racking arm may be provided to control movement of the lower ends of tubular stands and/or casing while being moved between the stand hand-off position and their racked position on the platform. Movements of the lower racking arm are controlled by movements of the upper racking arm to maintain the tubular stands in a vertical orientation.

In embodiments, a lower stand constraint may be provided to guide ascending and descending tubular stands to and away from the stand hand-off position and to secure the tubular stands vertically when at the stand hand-off position. A stand hand-off station may be located at the stand hand-off position to provide automatic washing and doping of the pin connection. A grease dispenser may also be provided on the tubular delivery arm for automatic doping of the pin end of the tubular stands.

In embodiments, an intermediate stand constraint may be provided and attached to the V-door side edge of the center section of the substructure of the drilling rig. The intermediate stand constraint may include a gripping assembly for gripping tubular stands to prevent their vertical movement while suspended over the mousehole to facilitate stand-building without the need for step positions in the mousehole assembly. The intermediate stand constraint may also have a clasp, and the ability to extend between the stand hand-off position and the mousehole.

In embodiments, a lower stabilizing arm may be provided at the drill floor level for guiding the lower portion of casing, drilling tubulars, and stands of the drilling tubulars between the catwalk, mousehole, and stand hand-off and well center positions.

In embodiments, a tubular connection machine such as an iron roughneck may be provided such as mounted to a rail on the drilling floor or attached to the end of a drill floor manipulating arm to move between a retracted position, the well center and the mousehole. The iron roughneck can make-up and break-out tool joints, e.g., drill pipe, casing, and so on, over the well center and the mousehole. A second iron roughneck may be provided to dedicate a first iron roughneck to connecting and disconnecting tubulars over the mousehole, and the second iron roughneck can be dedicated to connecting and disconnecting tubulars over the well center.

In embodiments, with this system, a tubular stand can be disconnected and hoisted away from the drill string suspended in the wellbore while the retractable top drive is travelling downwards to grasp and lift the drill string for hoisting. Similarly, a tubular stand can be positioned and stabbed over the wellbore without the retractable top drive, while the retractable top drive is travelling upwards to connect to the tubular stand. The simultaneous paths of the retractable top drive and tubular delivery arm may significantly reduce trip time.

In summary, with the disclosed embodiments, tubular stand hoisting from the stand hand-off position and delivery to well center is accomplished by the tubular delivery arm, and drill string hoisting and lowering is accomplished by the top drive. The top drive and tubular delivery arm pass each other in relative vertical movement on the same mast. The tilt and/or rotation control of the tubular delivery arm, and compatible geometry of the top drive, permit them to pass one another without conflict. In one embodiment, a conventional non-retractable top drive is used in conjunction with the tubular delivery arm, having only to pause to avoid conflict between the non-retractable top drive and the tubular delivery arm over the well center. Retraction capability of the top drive, where provided, can also allow simultaneous passage when the tubular delivery arm is over well center.

The disclosed embodiments provide a drilling rig system that may significantly reduce the time needed for tripping of drill pipe. The disclosed embodiments further provide a system with mechanically operative redundancies. The following disclosure describes "tripping in" which means adding tubular stands on a racking module to the drill string to form the complete length of the drill string to the bottom of the well so that drilling may commence. It will be appreciated by a person of ordinary skill that the procedure summarized below is generally reversed for tripping out of the well, i.e., removing and racking tubular stands from the drill string to pull out the bottom-hole assembly.

As will be understood by one of ordinary skill in the art, the embodiments disclosed may be modified and the same advantageous result obtained. It will also be understood that as the process of tripping in to add tubular stands to the wellbore is described, the procedure and mechanisms can be operated in reverse to remove tubular stands from the wellbore for orderly racking. Although a configuration related to triples is being described herein, a person of ordinary skill in the art will understand that such description is by example only as the disclosed embodiments are not limited, and would apply equally to doubles and fourables.

BRIEF DESCRIPTION OF THE DRAWINGS

The objects and features of the disclosed embodiments will become more readily understood from the following detailed description and appended claims when read in conjunction with the accompanying drawings in which like numerals represent like elements.

The drawings constitute a part of this specification and include embodiments that may be configured in various forms. It is to be understood that in some instances various aspects of the disclosed embodiments may be shown exaggerated or enlarged to facilitate their understanding.

DETAILED DESCRIPTION

The following description is presented to enable any person skilled in the art to make and use the disclosed embodiments, and is provided in the context of a particular application and its requirements. Various modifications to the disclosed embodiments will be readily apparent to those skilled in the art, and the general principles defined herein may be applied to other embodiments and applications without departing from the spirit and scope of the disclosed embodiments. Thus, the disclosed embodiments are not intended to be limited to the embodiments shown, but is to be accorded the widest scope consistent with the principles and features disclosed herein.

Figure 1:
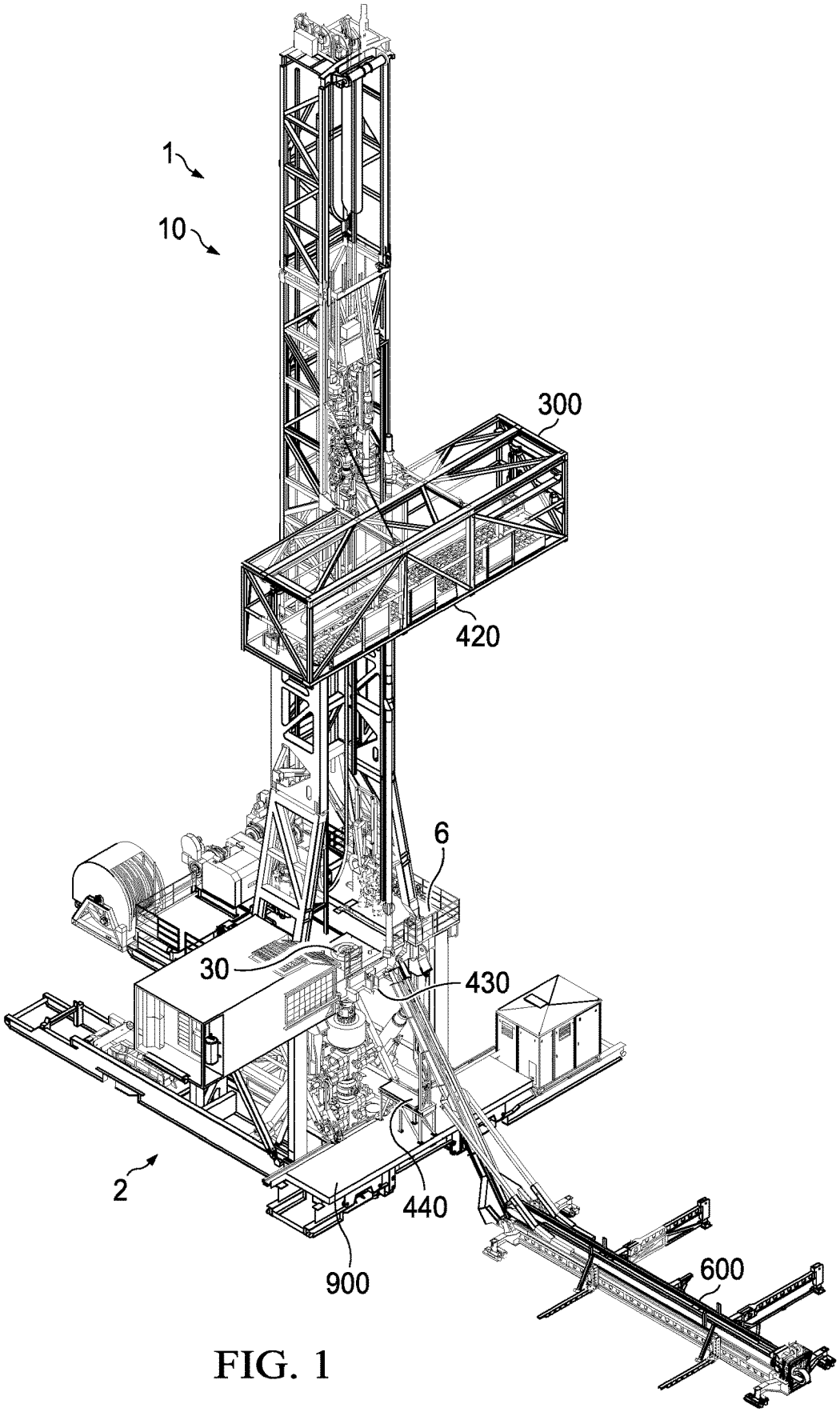
FIG. 1 is an isometric view of an embodiment of the drilling rig system of the disclosed embodiments for a high trip rate drilling rig.

FIG. 1 is an isometric view of an embodiment of the drilling rig system of the disclosed embodiments for a high trip rate drilling rig 1. FIG. 1 illustrates drilling rig 1 having the conventional front portion of the drill floor removed, and placing well center 30 near to the edge of drill floor 6. In this configuration, a setback platform 900 is located beneath the level of drill floor 6, and connected to base box sections of substructure 2 on the ground. In this position, setback platform 900 is beneath racking module 300 such that tubular stands 80 (see FIG. 33) located in racking module 300 and/or stand hand-off position 50 will be resting on setback platform 900.

Having setback platform 900 near ground level can reduce the size of the side boxes of substructure 2 and thus reduces side box transport weight, relative to a conventional setback platform at the height of the drill floor. This configuration also mitigates the effects of wind against mast 10.

In this configuration, racking module 300 is located lower on mast 10 of drilling rig 1 than on conventional land drilling rigs, since tubular stands 80 are not resting at drill floor 6 level. As a result, tubular stands 80 will need to be elevated significantly by a secondary hoisting means to reach the level of drill floor 6, before they can be added to the drill string.

A mousehole having a mousehole center 40 (see FIG. 30) is located on the forward edge of drill floor 6 in plan and extends downward beneath. An intermediate stand constraint 430 is located adjacent to drill floor 6 and can be centered over mousehole center 40. A stand hand-off position 50 is located on setback platform 900, and extends vertically upwards, and is not impeded by any other structure beneath racking module 300. A lower stand constraint 440 is located on setback platform 900 and can be centered over stand hand-off position 50. In this embodiment, stand hand-off position 50 is forward of, and in alignment with, well center 30 and mousehole center 40.

Figure 2:
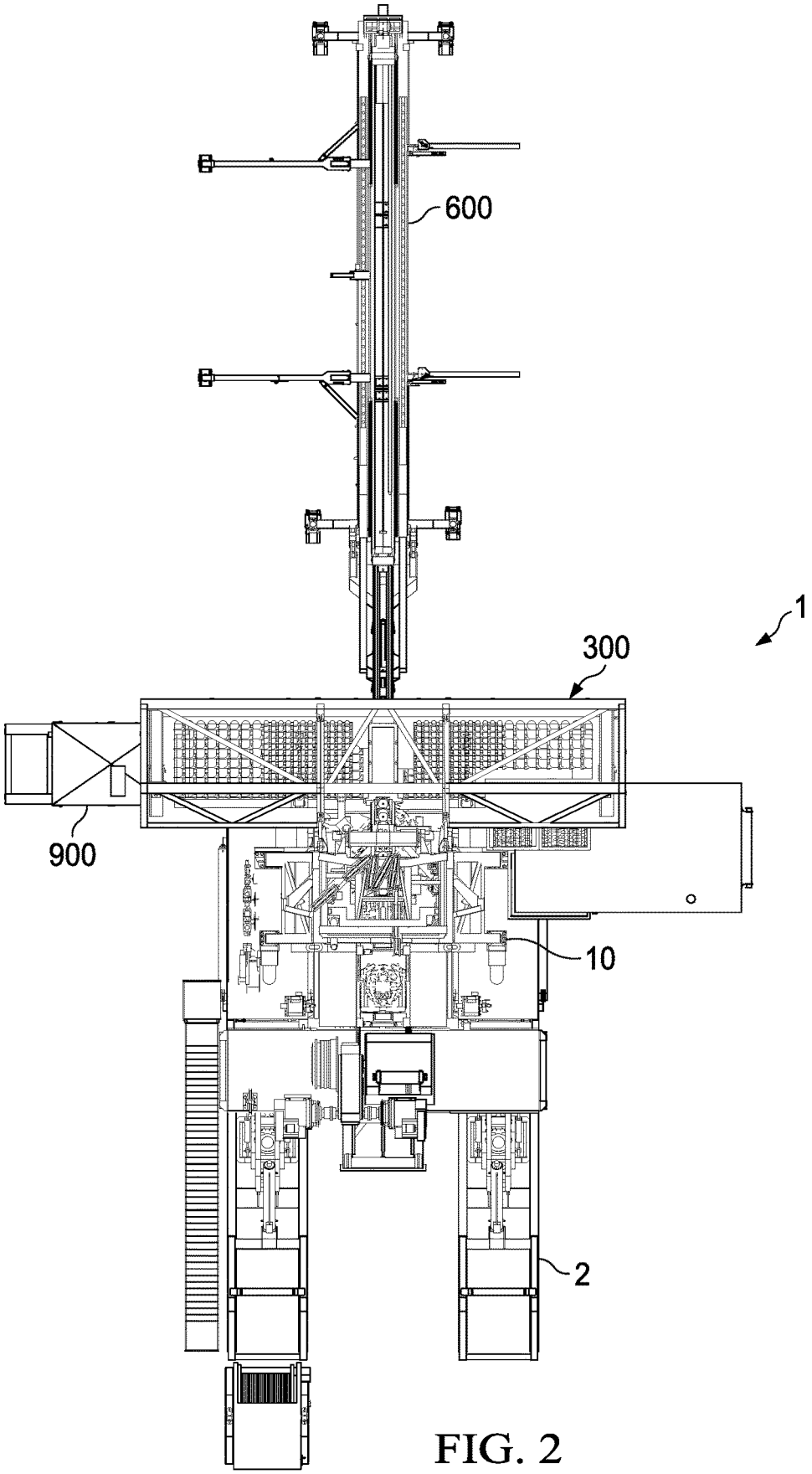
FIG. 2 is a top view of the embodiment of FIG. 1 of the disclosed embodiments for a high trip rate drilling rig.

FIG. 2 is a top view of the drilling rig 1 of FIG. 1. Racking module 300 has a fingerboard assembly 310 (see FIG. 7) that may have columns of racking positions 312 aligned perpendicular to conventional alignment. As so aligned, racking column positions 312 run in a V-door to drawworks direction. Drilling masts generally have a mast front or V-door side, and an opposite mast rear or drawworks side. Perpendicular to these sides are the driller's side and opposite off-driller's side. As seen in FIG. 2, the racking positions for tubular stands 80 in racking module 300 align with space for racking tubular stands on setback platform 900. The horizontal extents of the racking module 300 and setback platform 900 can be selected independent of the substructure 2 and mast 10, depending on the depth of the well to be drilled and the number of tubular stands 80 to be racked. In this manner, drilling rig 1 is scalable.

Figure 3:
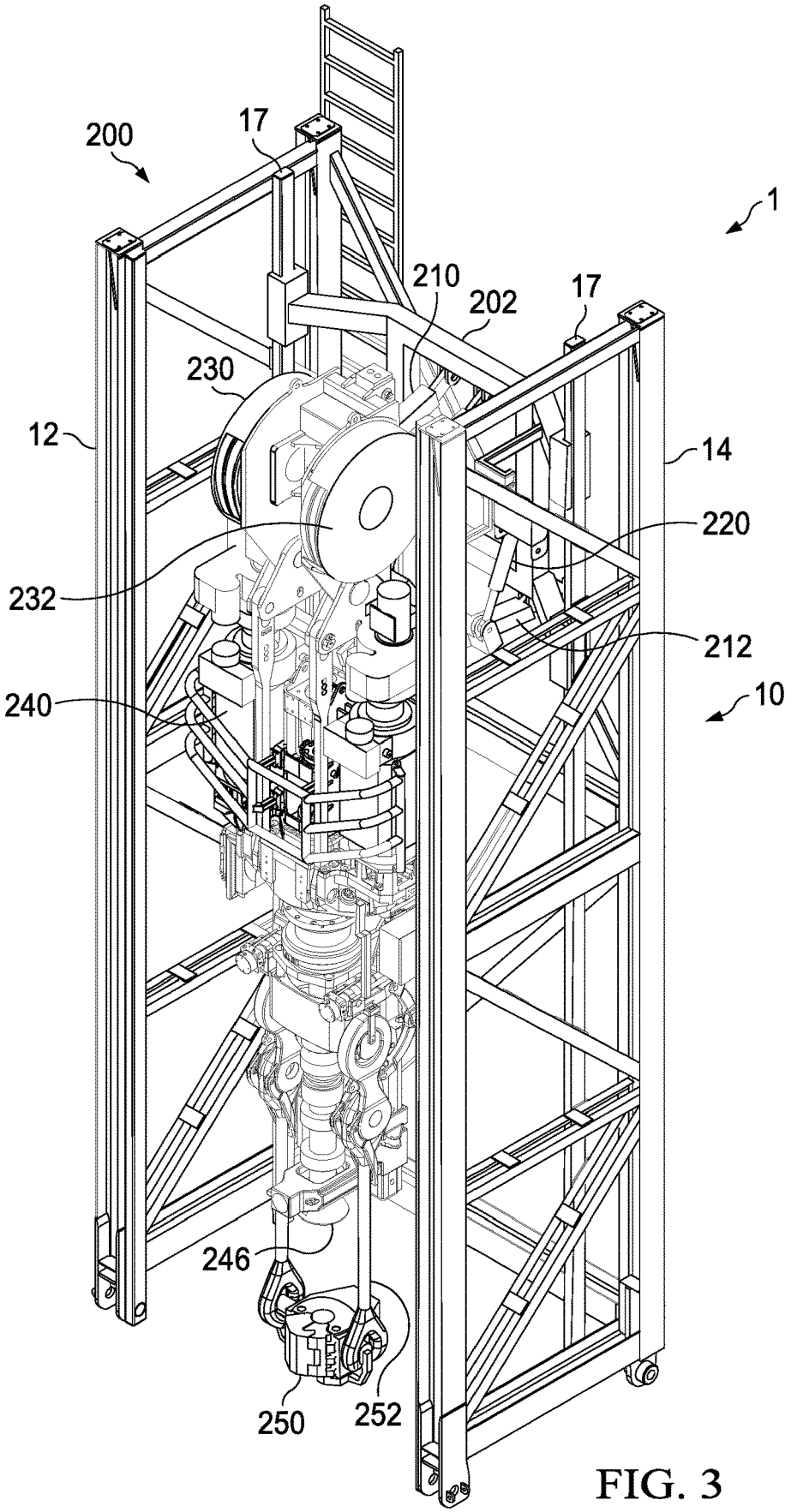
FIG. 3 is an isometric cut-away view of the retractable top drive in a drilling mast as used in an embodiment of the high trip rate drilling rig.

FIG. 3 is an isometric cut-away view of a retractable top drive assembly 200 in drilling mast 10 as used in an embodiment of drilling rig 1. Retractable top drive assembly 200 is generally comprised of a travelling block assembly (230, 232), a top drive 240, a pair of links 252 and an elevator 250, along with other various components. Retractable top drive assembly 200 has a retractable dolly 202 that is mounted on guides 17 in mast 10. In the embodiment illustrated, guides 17 are proximate to the rear side 14 (drawworks side) of mast 10. Dolly 202 is vertically translatable on the length of guides 17. In the embodiment illustrated, retractable top drive assembly 200 may have a split block configuration including a driller's side block 230 and an off-driller's side block 232. This feature provides mast-well center path clearance additional to that obtained by the ability to retract dolly 202. The additional clearance may facilitate avoiding conflict with a tubular delivery arm 500 (see FIG. 12) when tilted for well center 30 alignment of a tubular stand 80.

A first yoke 210 connects block halves 230 and 232 to dolly 202. A second yoke 212 extends between dolly 202 and top drive 240. An actuator 220 extends between second yoke 212 and dolly 202 to facilitate controlled movement of top drive 240 between a well center 30 position and a retracted position. Retractable top drive assembly 200 has a top drive 240 and a stabbing guide 246. Pivotal links 252 extend downward. An automatic elevator 250 is attached to the ends of links 252.

Figure 4:
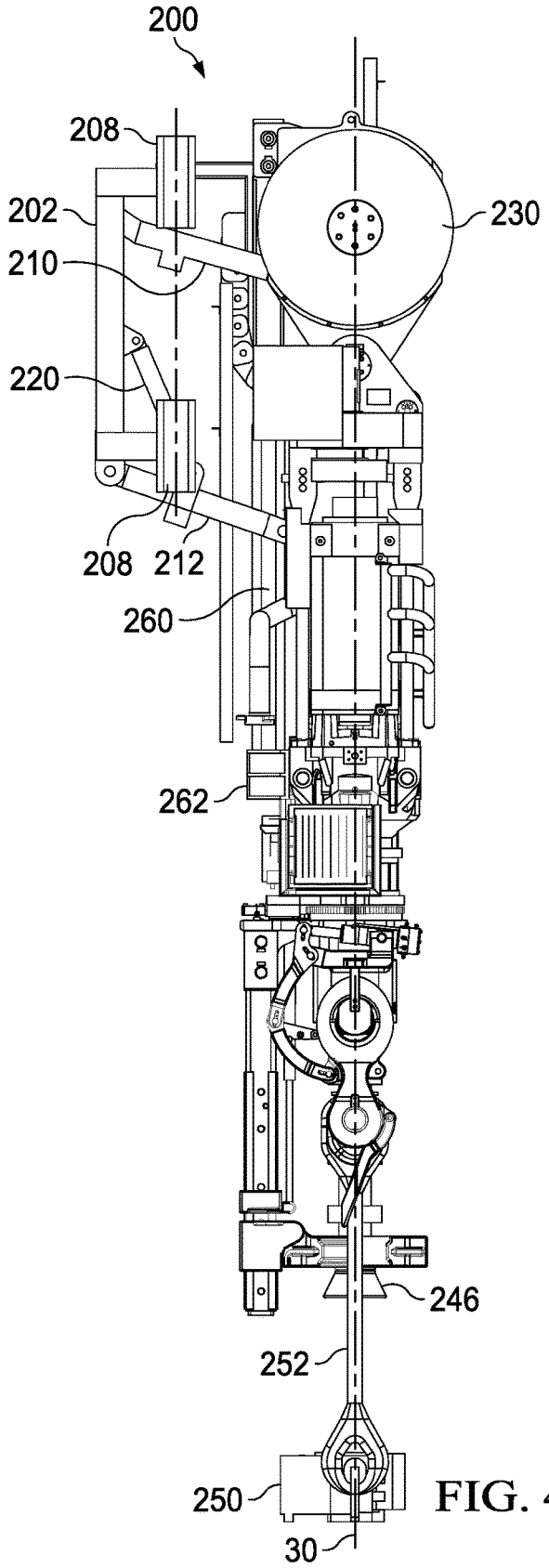
FIG. 4 is a side cut-away view of the retractable top drive, showing it positioned over the well center.

FIG. 4 is a side cut-away view of an embodiment of retractable top drive assembly 200, showing it positioned over well center 30. Retractable top drive assembly 200 has a torque tube 260 that functions to transfer torque from retractable top drive assembly 200 to dolly 202 and there through to guides 17 and mast 10. (See also FIG. 6).

Figure 5:
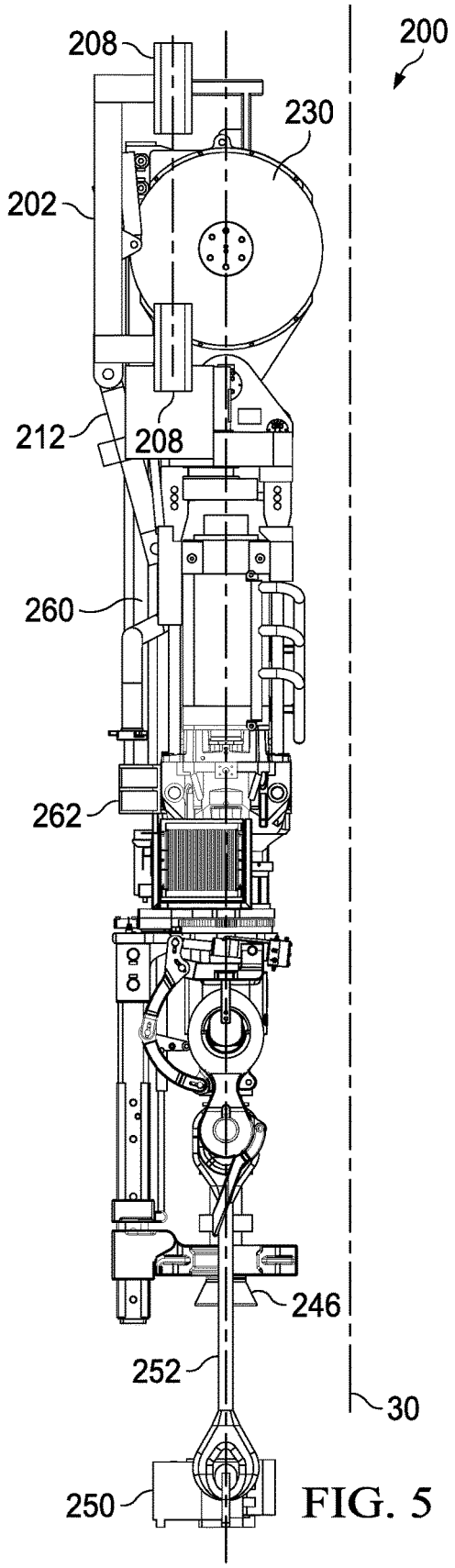
FIG. 5 is a side cut-away view of the retractable top drive, showing it retracted from its position over the well center.

FIG. 5 is a side cut-away view of the embodiment of retractable top drive assembly 200 in FIG. 4, showing it retracted from its position over well center 30, e.g., to avoid contact with any tubular stand positioned over well center and/or the tubular delivery arm 500 that may vertically translate the same mast 10 as retractable top drive assembly 200 with the tubular clasp 550 (see FIG. 12) positioned over well center.

Figure 6:
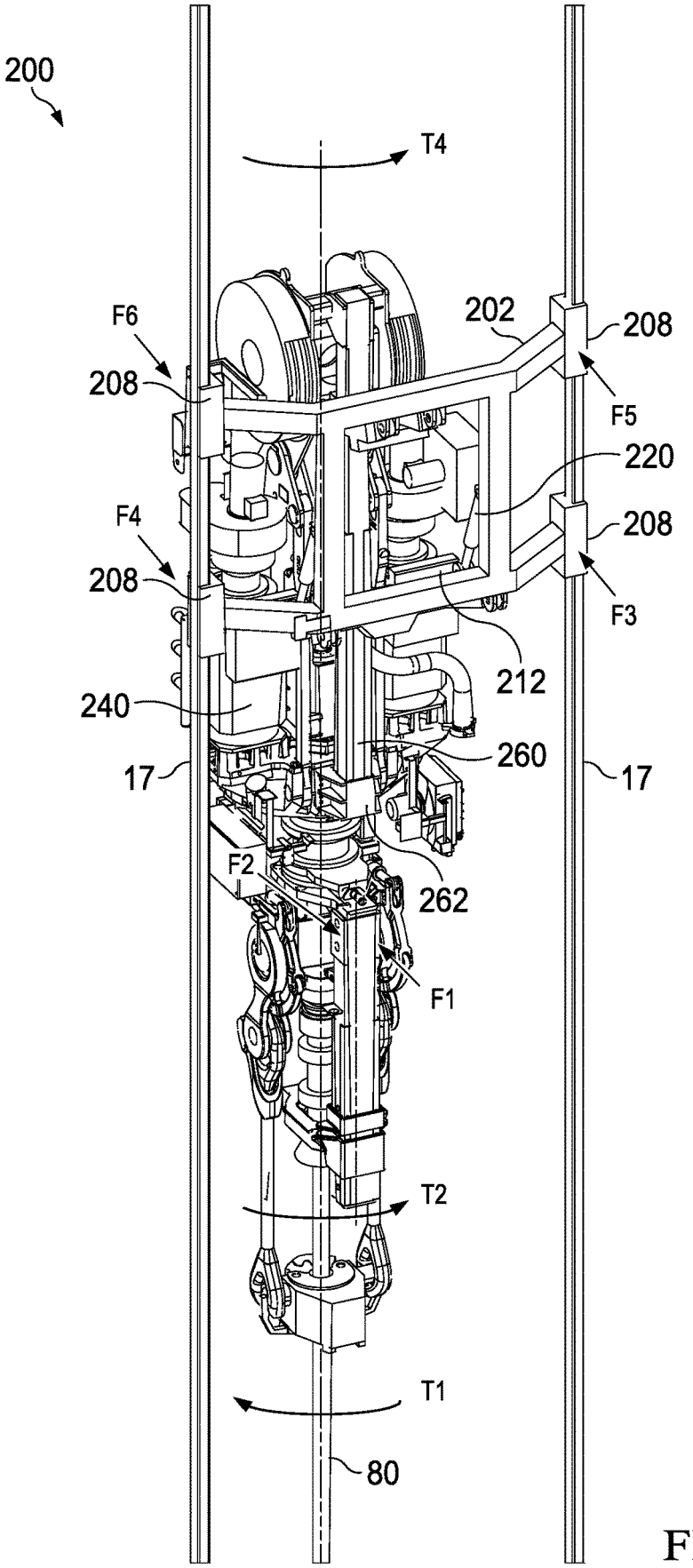
FIG. 6 is an isometric simplified block diagram illustrating the transfer of reaction torque to the top drive, to the torque tube, to the travelling block, to the dolly, and to the mast.

FIG. 6 is an isometric cut-away view, illustrating the force transmitted through torque tube 260 connected directly to the travel block assembly. Torque tube 260 may be solidly attached to the travelling block assembly, such as between block halves 230 and 232, and thus connected to dolly 202 through yoke 210 and yoke 212.

Torque is encountered from make-up and break-out activity as well as drilling torque reacting from the drill bit and stabilizer engagement with the wellbore. Torque tube 260 is engaged to top drive 240 at torque tube bracket 262 in sliding relationship. Top drive 240 is vertically separable from the travelling block assembly to accommodate different thread lengths in tubular couplings. The sliding relationship of the connection at torque tube bracket 262 accommodates this movement.

Slide pads 208 are seen in this view. Slide pads 208 are mounted on opposing ends of dolly 202 that extend outward in the driller's side and off-driller's side directions. Each dolly end may have an adjustment pad (not visible) between its end 204 and slide pad 208. Slide pads 208 engage guides 17 to guide retractable top drive assembly 200 up and down the vertical length of mast 10. Adjustment pads may permit precise centering and alignment of dolly 202 on mast 10. Alternatively, a roller mechanism may be used.

In FIG. 6, retractable top drive assembly 200 is positioned over well center 30. As seen in this view, tubular stand 80 is right rotated by top drive 240 as shown by T1. Drilling related friction at the drill bit, stabilizers and bottom hole assembly components must be overcome to drill ahead. This results in a significant reactive torque T2 at top drive 240. Torque T2 is transmitted to torque tube 260 through opposite forces F1 and F2 at bracket 262. Torque tube 260 transmits this torque to second yoke 212, which transmits the force to connected dolly 202. Dolly 202 transmits the force to guides 17 of mast 10 through its slide pads 208.

By this configuration, torque tube 260 is extended and retracted with top drive 240 and the travelling block. By firmly connecting torque tube 260 directly to the travelling block and eliminating a dolly at top drive 240, retractable top drive assembly 200 can accommodate a tubular delivery arm 500 on common mast 10.

Figure 7:
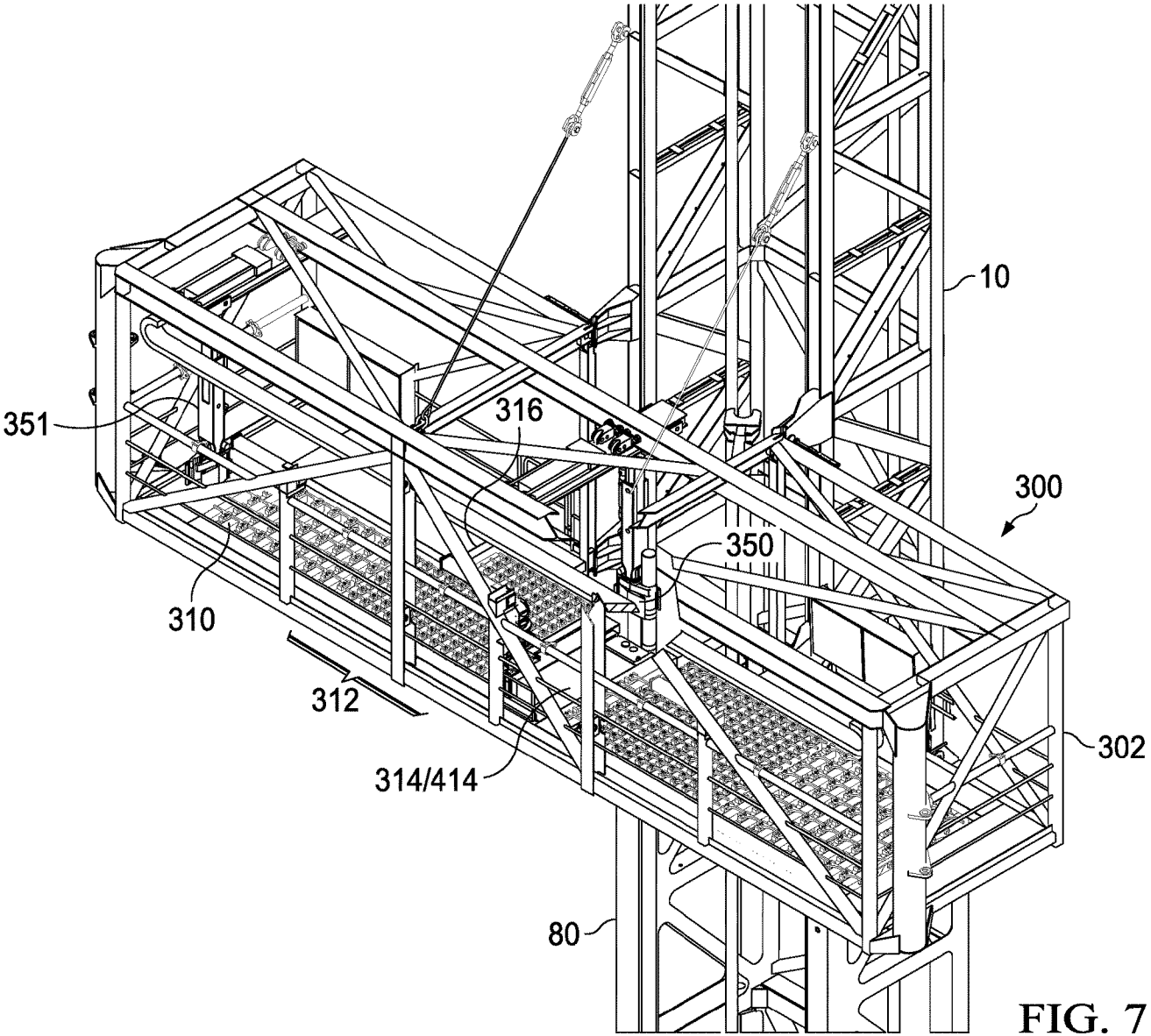
FIG. 7 is an isometric view of the racking module, illustrating the upper racking arm translating the alleyway and delivering a tubular stand to (or retrieving it from) a stand hand-off position.

FIG. 7 is an isometric view of a racking module 300 component of the disclosed embodiments, illustrating an upper racking arm 350 traversing an alleyway 316 in the direction of the opening on the front side of mast 10, towards stand hand-off position 50. As shown, upper racking arm 350 has reached stand hand-off position 50 with tubular stand 80 (or hoisted tubular stand 80 from its set-down position in the stand hand-off position 50).

Figure 8:
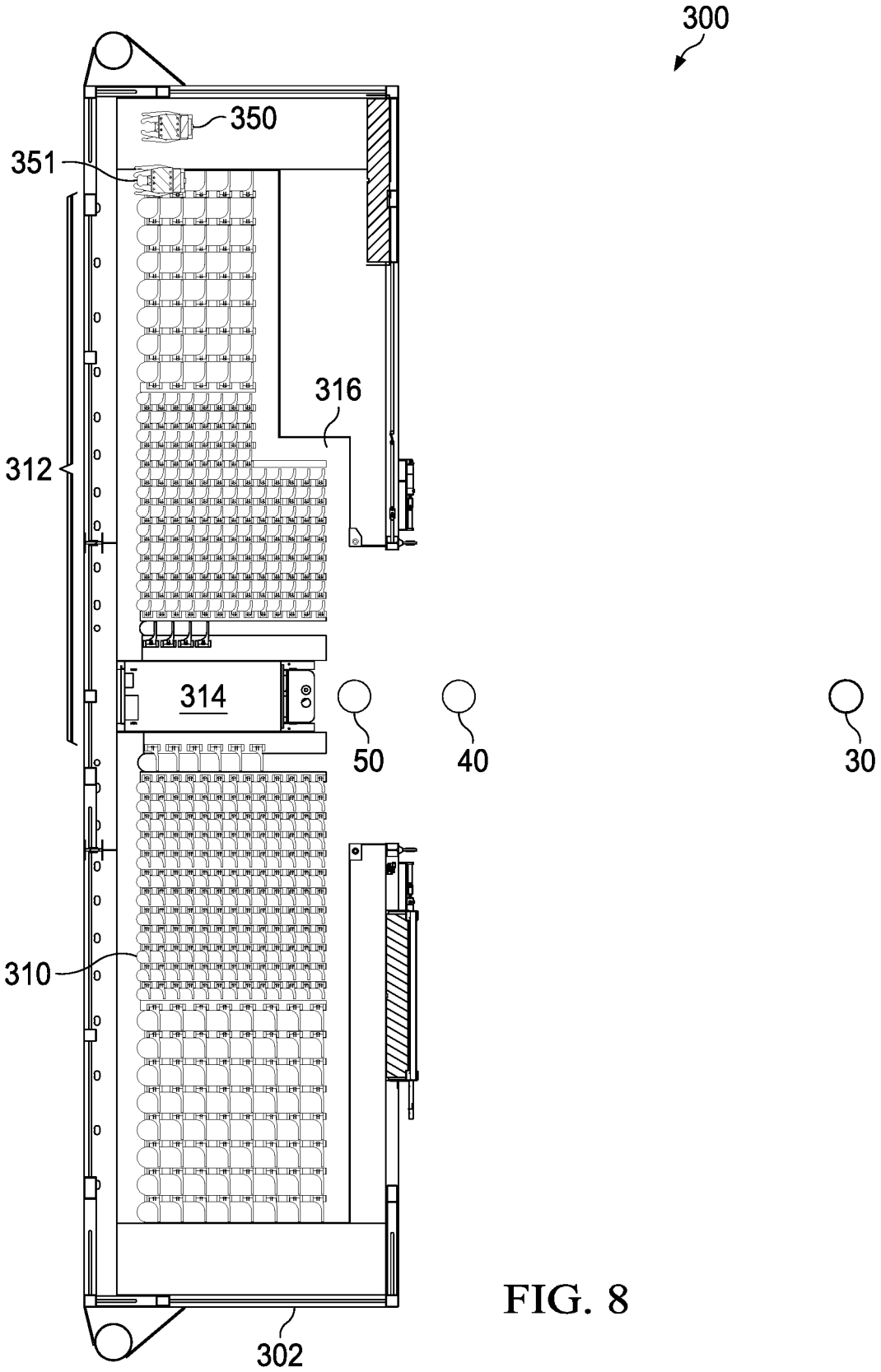
FIG. 8 is a top view of the racking module, illustrating the operating envelope of the upper racking arm and the relationship of the stand hand-off position to the racking module, well center and mousehole.

FIG. 8 is a top view of racking module 300, illustrating the operating envelope of upper racking arm 350, and the relationship of stand hand-off position 50 to racking module 300. As illustrated in FIG. 7, fingerboard assembly 310 provides a rectangular grid of multiple tubular storage positions between its fingers. Fingerboard assembly 310 has racking column positions 312 aligned in a V-door to drawworks direction.

Upper racking arm 350 has the ability to position its gripper 382 (see FIG. 9) over the tubular racking column positions 312 in the grid. In the embodiment illustrated, second upper racking arm 351 also has the capability of positioning its gripper 382 over the tubular racking column positions 312 on fingerboard assembly 310.

Figure 9:
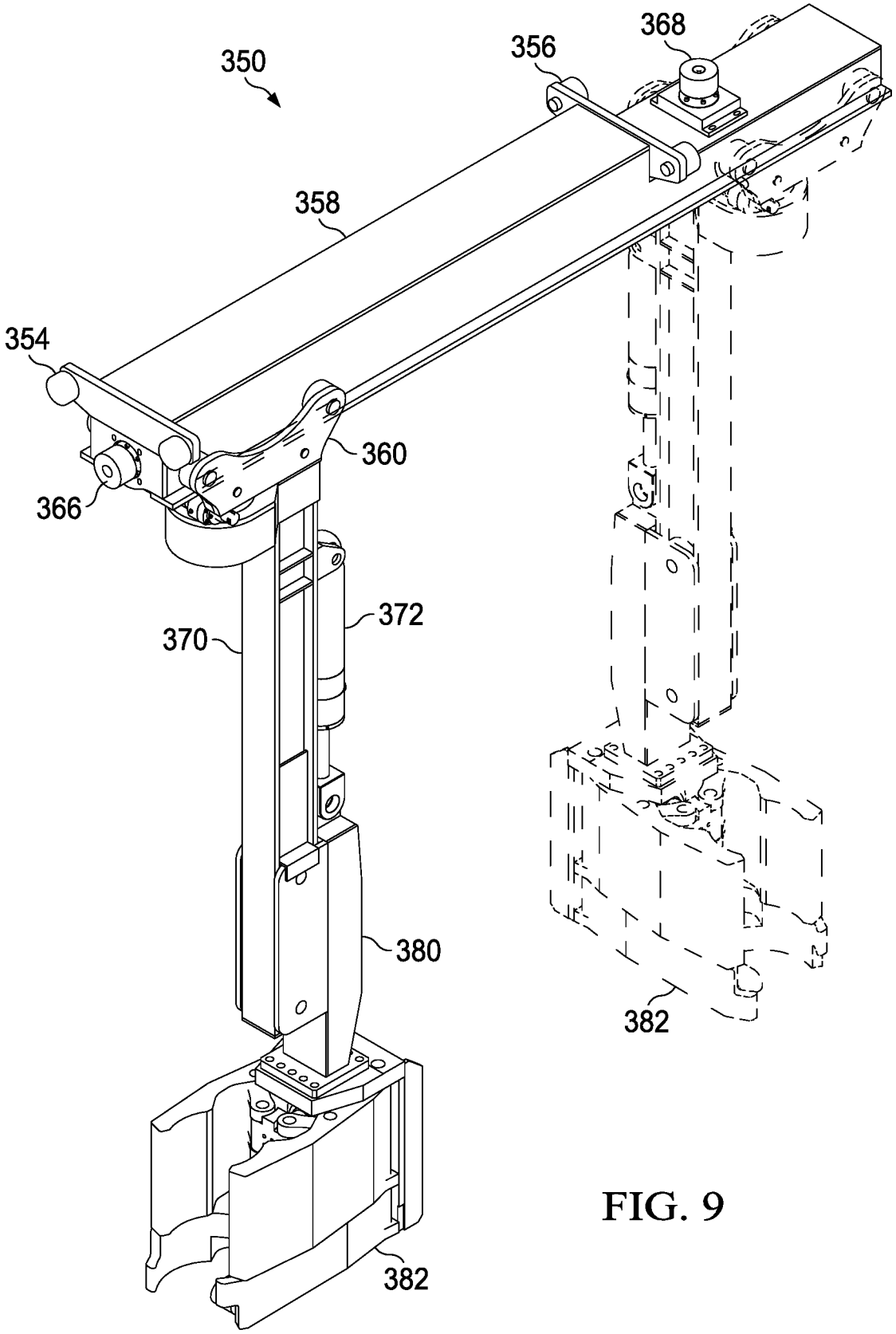
FIG. 9 is an isometric view of an embodiment of an upper racking arm component of the racking module of the disclosed embodiments, illustrating rotation of the arm member suspended from the bridge.

FIG. 9 is an isometric view of an embodiment of upper racking arm 350, illustrating the travel range and rotation of gripper 382 connected to sleeve 380 and upper racking arm member 370, as suspended from bridge 358.

Upper racking arm 350 has a bridge 358 and a modular frame 302 comprising an inner runway 304 and an outer runway 306. Bridge 358 has an outer roller assembly 354 and an inner roller assembly 356 for supporting movement of upper racking arm 350 along runways 306 and 304, respectively (see FIG. 11), on racking module 300.

An outer pinion drive 366 extends from an outer end of bridge 358. An inner pinion drive 368 extends proximate to the inner end (mast side) of bridge 358. Pinion drives 366 and 368 engage complementary geared racks on runways 306 and 304. Actuation of pinion drives 366 and 368 permits upper racking arm 350 to horizontally translate the length of racking module 300.

A trolley 360 is translatably mounted to bridge 358. The position of trolley 360 is controlled by a trolley pinion drive that engages a complementary geared rack on bridge 358. Actuation of the trolley pinion drive permits trolley 360 to horizontally translate the length of bridge 358.

A rotate actuator is mounted to trolley 360. Upper racking arm member 370 is connected at an offset to rotate actuator 362 and thus trolley 360. Gripper 382 extends perpendicular in relation to the lower end of arm member 370, and in the same plane as the offset. Gripper 382 is attached to sleeve 380 for gripping tubular stands 80 (see FIG. 20) racked in racking module 300. Sleeve 380 is mounted to arm member 370 in vertically translatable relation, as further described below. Actuation of the rotate actuator causes rotation of gripper 382.

A rotate actuator centerline extends downward from the center of rotation of the rotate actuator. This centerline is common to the centerline of a tubular stand 80 gripped by gripper 382, such that rotation of gripper 382 results in centered rotation of tubular stand 80 without lateral movement. The ghost lines of this view show upper racking arm member 370 and gripper 382 rotated 90 degrees by the rotate actuator. As shown, and as described above, the centerline of a tubular stand 80 gripped by upper racking arm 350 can maintain its lateral position when arm member 370 is rotated.

As stated above, sleeve 380 is mounted to upper racking arm member 370 in vertically translatable relation, such as by slide bearings, rollers, or other method. In the embodiment illustrated, a tandem cylinder assembly 372 is connected between arm member 370 and sleeve 380. Tandem cylinder assembly 372 comprises a counterbalance cylinder and a lift cylinder. Actuation of the lift cylinder is operator controllable with conventional hydraulic controls. Tubular stand 80 is hoisted by retraction of the lift cylinder. The counterbalance cylinder of the tandem cylinder assembly 372 is in the extended position when there is no load on gripper 382.

When tubular stand 80 is set down, the counterbalance cylinder retracts to provide a positive indication of set down of tubular stand 80. Set down retraction of the counterbalance cylinder is measured by a transducer (not shown) such as a linear position transducer. The transducer provides this feedback to help prevent lateral movement of tubular stand 80 before it has been lifted, which may result in damage.

Figure 10:
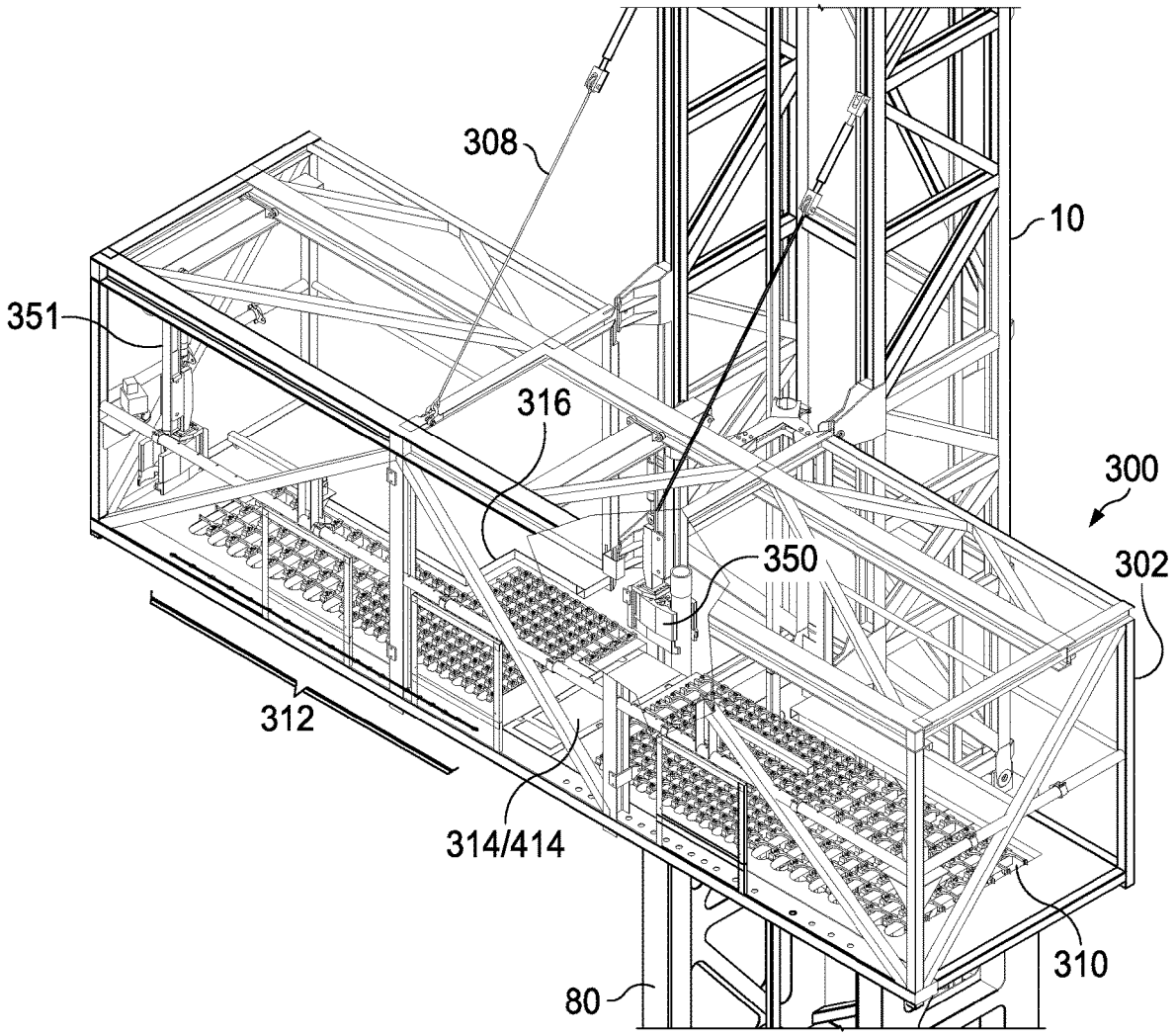
FIG. 10 is an isometric break-out view of an embodiment of the racking module, illustrating the upper racking arm translating the alleyway and delivering the tubular stand to (or retrieving it from) the stand hand-off position.

FIG. 10 is an isometric view of an embodiment of racking module 300 and upper racking arm 350. As illustrated, upper racking arm 350 is hoisting a tubular stand 80 over the stand hand-off position 50. For tripping in, upper racking arm 350 has retrieved the tubular stand 80 from a racking column position 312 of fingerboard assembly 310 and carried it along alleyway 316 to the stand hand-off position 50. For tripping out, upper racking arm 350 has hoisted the tubular stand 80 off of the setback platform 900 (FIG. 1) in preparation to carry it along alleyway 316 for racking in the fingerboard assembly 310.

Figure 11:
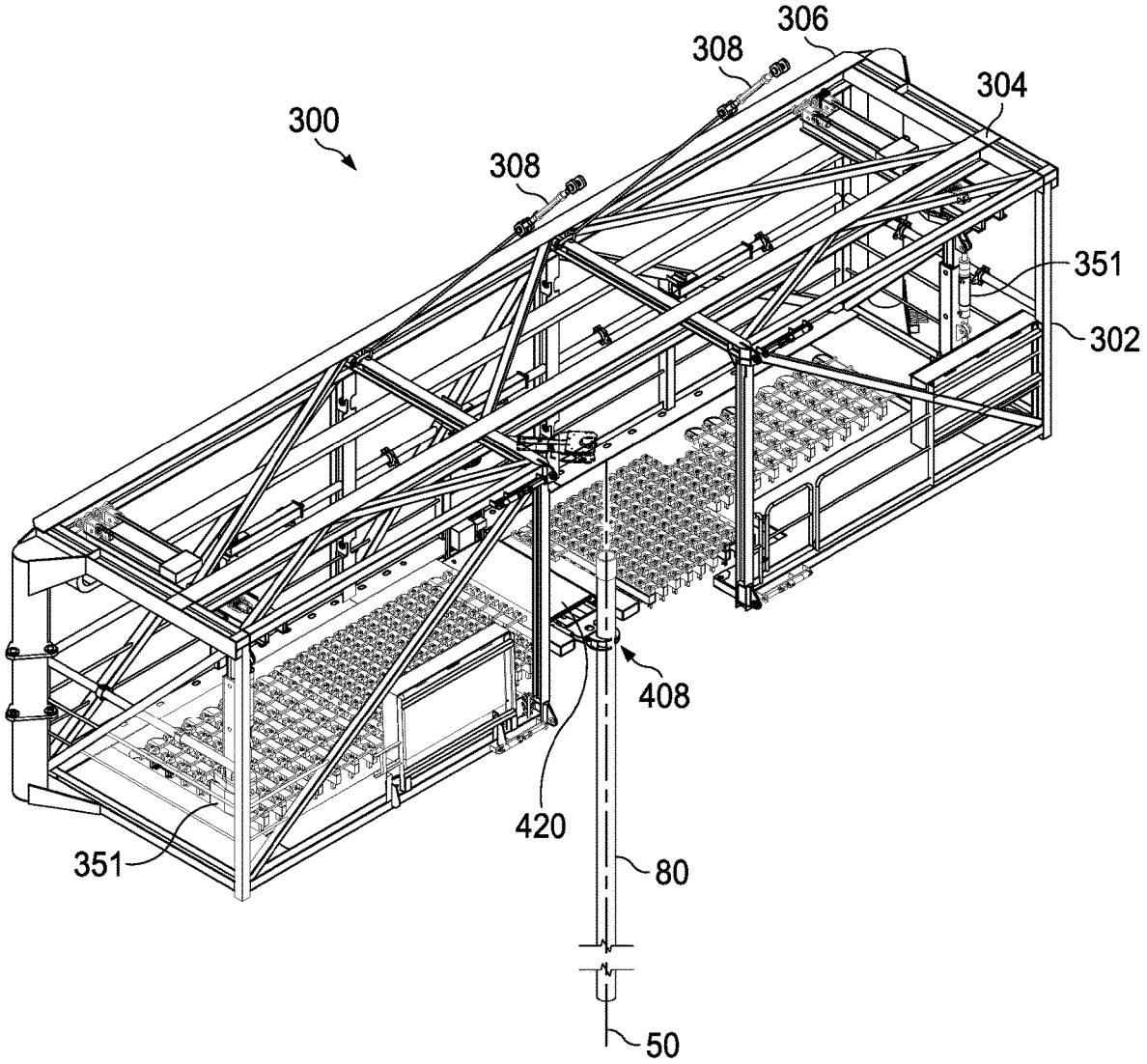
FIG. 11 an isometric view of the racking module from the opposite side, illustrating the upper stand constraint securing the tubular stand in position at the stand hand-off position. The upper racking arm, having set the tubular stand down, has released the tubular stand and returned to retrieve another; or the tubular delivery arm has set the tubular stand down, and the upper racking arm is returning to retrieve it from the hand-off position.

FIG. 11 is an isometric view of racking module 300 of FIG. 7 shown from the opposite side to illustrate clasp 408 of upper stand constraint 420 holding tubular stand 80 at stand hand-off position 50. Mast 10 is removed from this view for clarity, and the two upper racking arms 350, 351 are shown moved to the sides of the racking module 300.

For tripping in, upper racking arm 350 (or 351) has lowered tubular stand 80 at stand hand-off position 50 and departed to retrieve the next tubular stand 80. For tripping out, upper racking arm 350 (or 351) is returning to the stand hand-off position 50 after racking the previous tubular stand. Upper stand constraint 420 acts to secure tubular stand 80 in place at stand hand-off position 50. This facilitates delivery of tubular stand 80 and other tubular stands (such as drill collars) between the stand hand-off position 50 and upper racking arms 350, 351 and also between the stand hand-off position 50 and tubular delivery arm 500 or retractable top drive assembly 200.

Upper stand constraint 420 has the ability to extend its clasp 408 further towards well center 30 to tilt tubular stand 80 sufficiently to render it accessible to retractable top drive assembly 200. This allows upper stand constraint 420 to provide a redundant mechanism to failure of the tubular delivery arm 500. Upper stand constraint 420 can also be used to deliver certain drill collars and other heavy tubular stands 80 that exceed the lifting capacity of tubular delivery arm 500.

Figure 12:
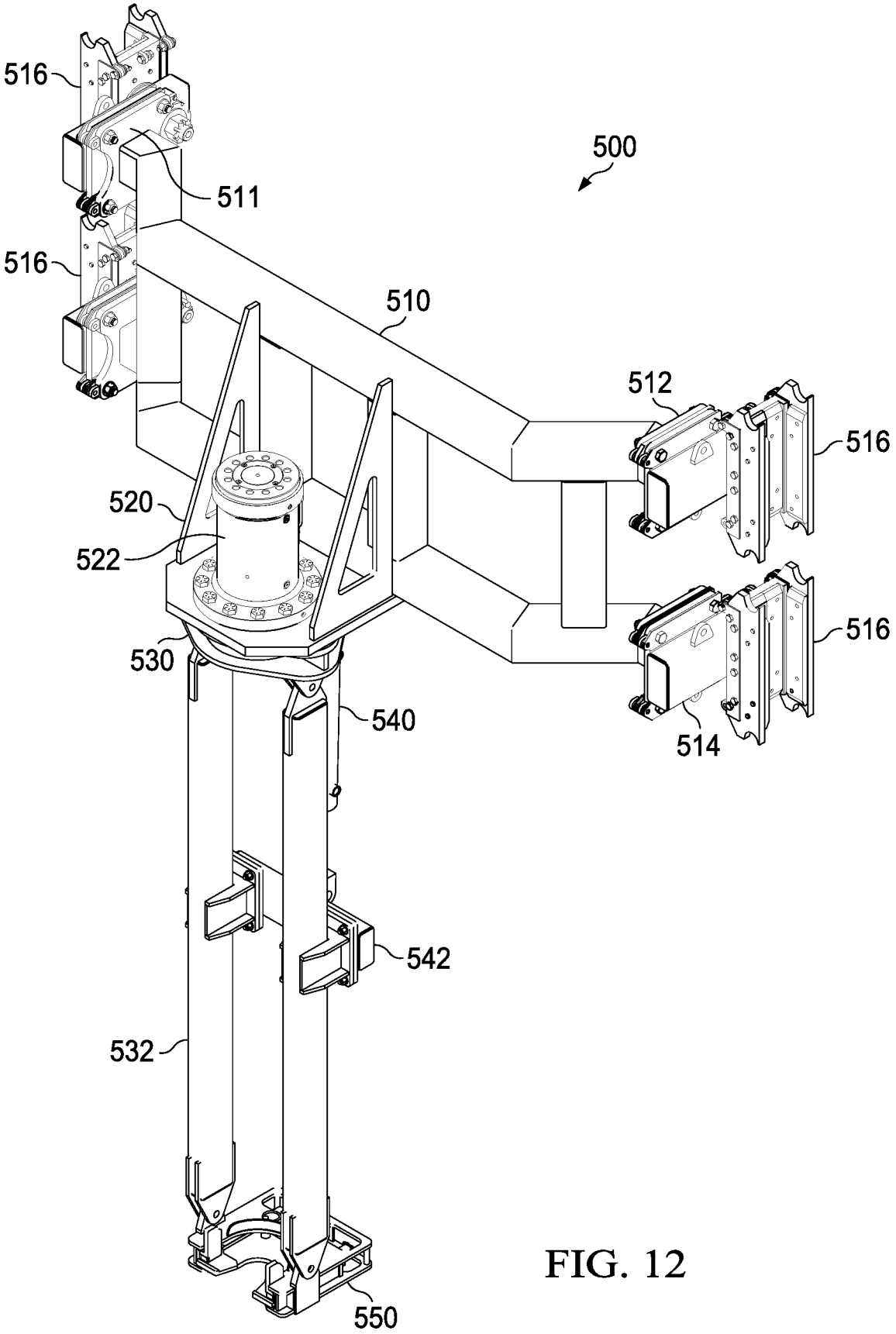
FIG. 12 is an isometric view of an embodiment of the tubular delivery arm component of the high trip rate drilling rig, shown having a free pivoting tubular clasp.

FIG. 12 is an isometric view of an embodiment of tubular delivery arm 500 of the disclosed embodiments. Retractable top drive assembly 200 provides a first tubular handling device that vertically translates mast 10. Tubular delivery arm 500 provides a second tubular handling device that is vertically translatable along the same mast 10 of transportable land drilling rig 1, without physically interfering with retractable top drive assembly 200.

Tubular delivery arm 500 comprises a dolly 510. In one embodiment, adjustment pads 514 are attached to ends 511 and 512 of dolly 510. A slide pad 516 may be located on each adjustment pad 514. Slide pads 516 are configured for sliding engagement with front side 12 of mast 10 of drilling rig 1. Adjustment pads 514 permit precise centering and alignment of dolly 510 on mast 10. In alternative embodiments, rollers or rack and pinion arrangements may be incorporated in place of slide pads 516.

An arm bracket 520 extends outward from dolly 510 in the V-door direction. An arm member 532 or pair of arm members 532 is pivotally and rotationally connected to arm bracket 520. An actuator bracket 542 is connected between arm members 532. A tilt actuator 540 is pivotally connected between actuator bracket 542 and one of either dolly 510 or arm bracket 520 to control the pivotal relationship between arm member 532 and dolly 510.

Rotary actuator 522 (or other rotary motor) provides rotational control of arm member 532 relative to dolly 510. A tubular clasp 550 is pivotally connected to the lower end of each arm member 532. Rotary actuator 522 is mounted to arm bracket 520 and has a drive shaft (not shown) extending through arm bracket 520. A drive plate 530 is rotatably connected to the underside of arm bracket 520 and connected to the drive shaft of rotary actuator 522. In this embodiment, clasp 550 may be optionally rotated to face tubular stand 80 at stand hand-off position 50 facing the V-door direction. Flexibility in orientation of clasp 550 reduces manipulation of tubular delivery arm 500 to capture tubular stand 80 at stand hand-off position 50 by eliminating the need to further rise, tilt, pass, and clear tubular stand 80.

A centerline of a tubular stand 80 secured in clasp 550 is located between pivot connections 534 at the lower ends of each arm member 532. In this manner, clasp 550 can be self-balancing to suspend a tubular stand 80 vertically, without the need for additional angular controls or adjustments.

Figure 13:
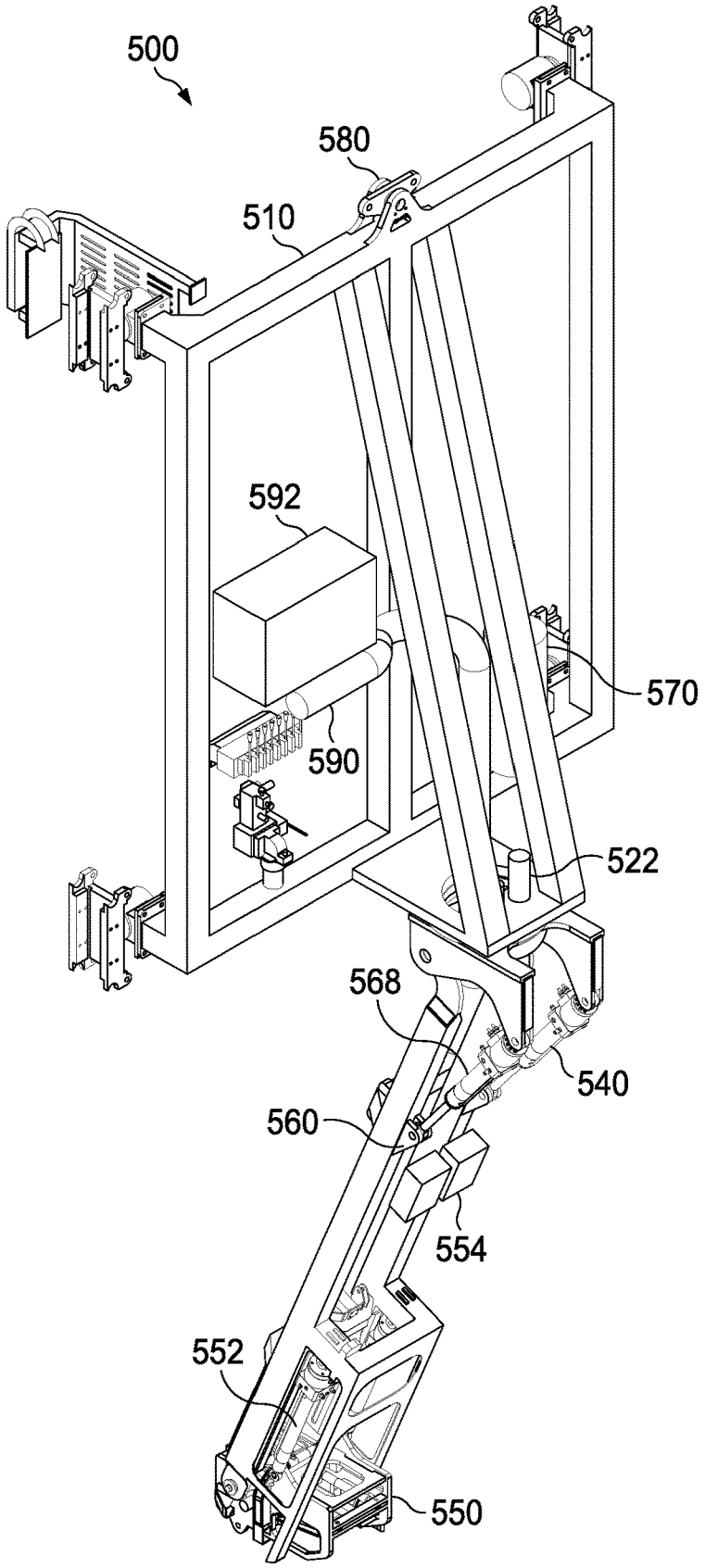
FIG. 13 is an isometric view of another embodiment of the tubular delivery arm, having an incline controlled tubular clasp and an automatic box doping apparatus.
Figure 14:
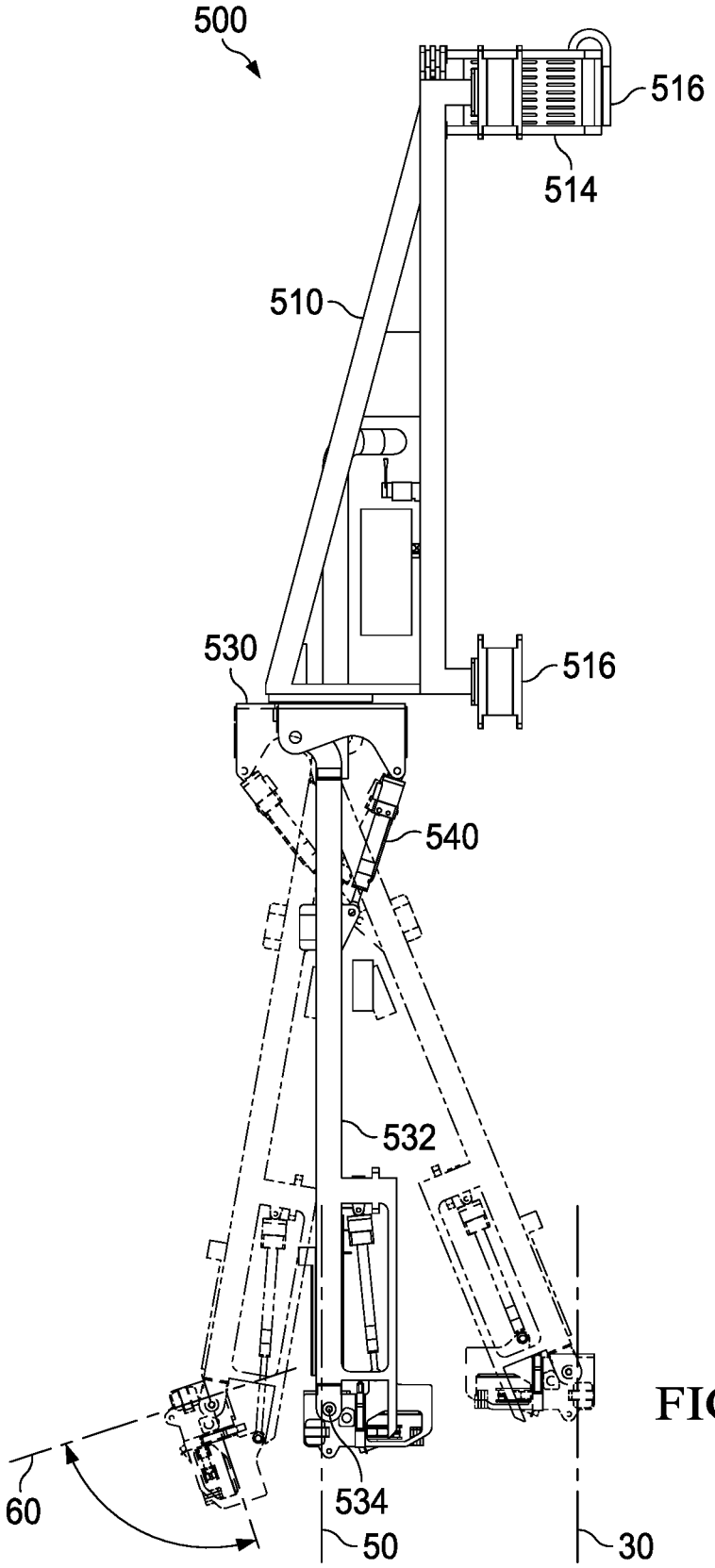
FIG. 14 is a side view of an embodiment of the tubular delivery arm, illustrating the range of the tubular delivery arm to position a tubular stand relative to positions of use on a drilling rig.

FIG. 13 is an isometric view of another embodiment of the tubular delivery arm 500. In this embodiment, an incline actuator 552 is operative to control the angle of tubular clasp 550 relative to arm member 532. This view illustrates arm members 532 rotated and tilted to position clasp 550 to face or over well center 30 as seen in FIG. 14. As also seen in FIG. 14, extension of the incline actuator 552 inclines tubular clasp 550 to permit tilting of heavy tubular stands, such as large collars, toward well center for connection to the top drive as discussed above, and to position tubular clasp 550 properly for receiving a single tubular section (or tubular stand 80) from a sloped portion of the catwalk 600 (FIG. 1) at catwalk position 60 (FIG. 14).

Referring to FIG. 13, a grease dispenser 560 is extendably connected to a lower end of arm member 532 above clasp 550, and extendable to position grease dispenser 560 at least partially inside of a box connection of tubular stand 80 secured by clasp 550. A grease supply line is connected between grease dispenser 560 and a grease reservoir 570 for this purpose. In this embodiment, grease dispenser 560 may be actuated to deliver grease, such as by pressurized delivery to the interior of the box connection by either or both of spray nozzles or contact wipe application.

This embodiment permits grease (conventionally known as "dope") to be stored in pressurized grease container 570 and strategically sprayed into a box connection of a tubular stand 80 held by clasp 550 prior to its movement over well center 30 for connection. The automatic doping procedure improves safety by eliminating the manual application at the elevated position of tubular stand 80.

FIG. 14 illustrates the lateral range of the motion of tubular delivery arm 500 to position a tubular stand 80 relative to positions of use on drilling rig 1. Illustrated is the capability of tubular delivery arm 500 to retrieve and deliver a tubular stand 80 as between a well center 30, a mousehole position 40 (not shown), and a stand hand-off position 50. Also illustrated is the capability of tubular delivery arm 500 to move to a catwalk position 60 and incline clasp 550 for the purpose of retrieving or delivering a tubular section from a catwalk 600 (see FIG. 1).

Figure 15:
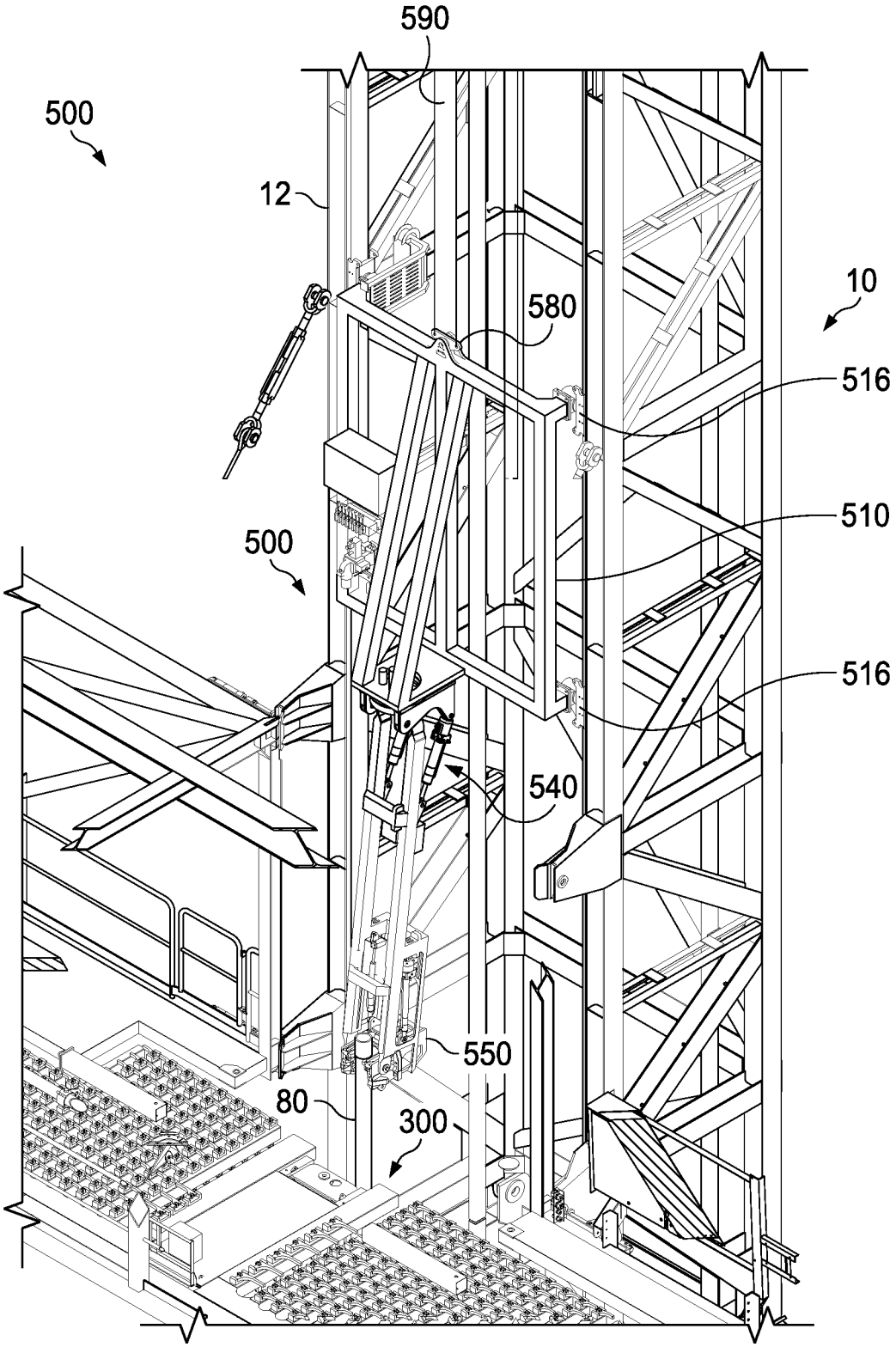
FIG. 15 is an isometric view of the embodiment of the tubular delivery arm of FIG. 13, illustrating the tubular delivery arm articulated to the stand hand-off position clasping a tubular stand.

FIG. 15 is an isometric view of an embodiment illustrating tubular delivery arm 500 articulated to stand hand-off position 50 between racking module 300 and mast 10, and having a tubular stand 80 secured in clasp 550.

Slide pads 516 are slidably engaged with the front side (V-door side) 12 of mast 10 to permit tubular delivery arm 500 to vertically traverse front side 12 of mast 10. Tilt actuator 540 positions clasp 550 over stand hand-off position 50. Tubular delivery arm 500 may have a hoist connection 580 on dolly 510 for connection to a hoist at the crown block to facilitate movement of tubular delivery arm 500 vertically along mast 10.

Figure 16:
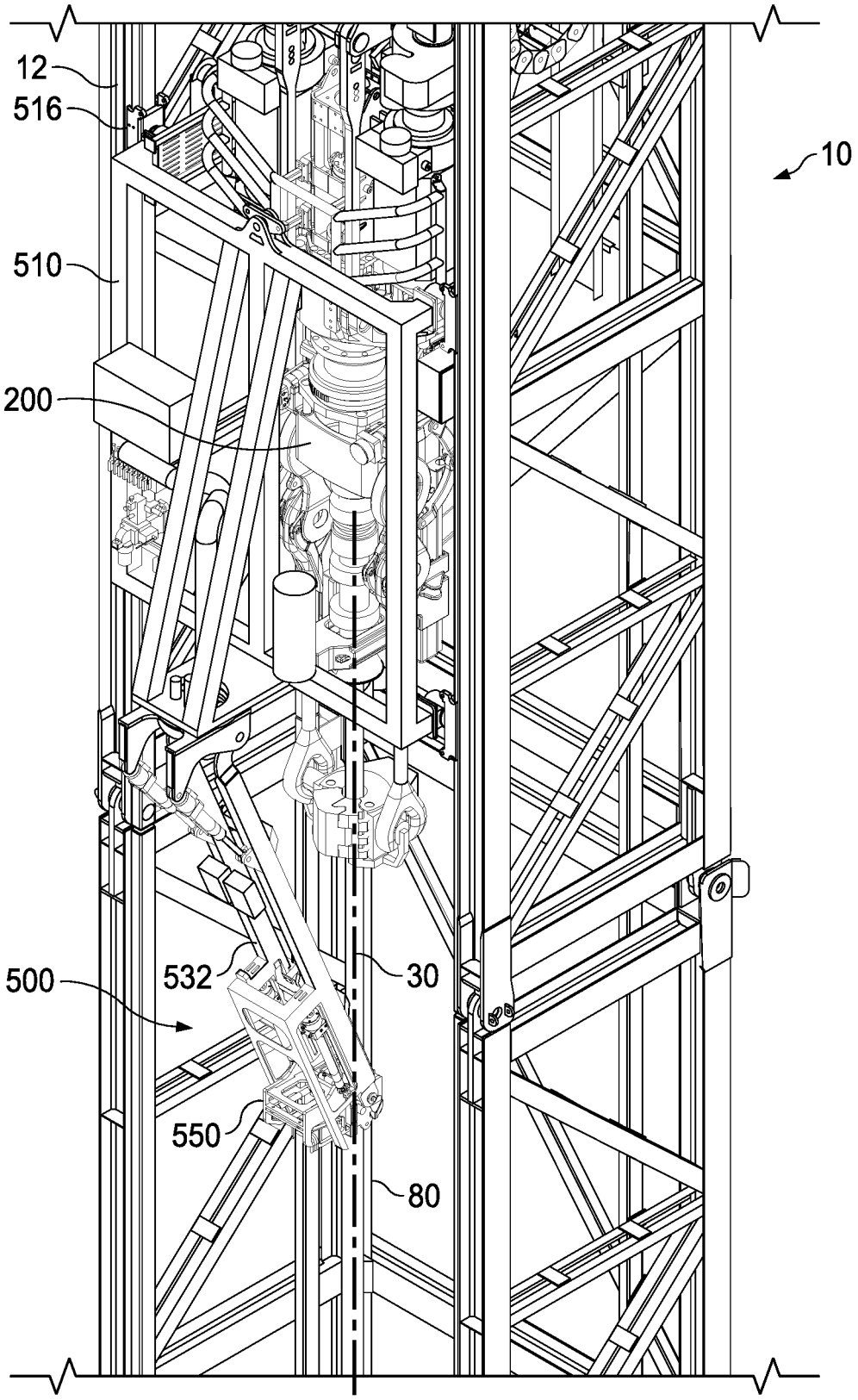
FIG. 16 is an isometric view of the embodiment of the tubular delivery arm of FIG. 13, illustrating the tubular delivery arm articulated over the well center and positioned for handing off a tubular stand between the top drive and the tubular delivery arm.

FIG. 16 is an isometric view of the embodiment of tubular delivery arm 500 of FIG. 14, illustrating tubular delivery arm 500 being articulated over well center 30 and handing tubular stand 80 off to retractable top drive assembly 200. Tubular delivery arm 500 is articulated by expansion of tilt actuator 540, which inclines arm members 532 into position such that the centerline of tubular stand 80 in clasp 550 is directly over well center 30.

In this manner, tubular delivery arm 500 is delivering and stabbing tubular stands for retractable top drive assembly 200. This allows independent and simultaneous movement of retractable top drive assembly 200, for tripping in, to lower the drill string into the well (set slips), disengage the drill string, retract, and travel vertically up mast 10 while tubular delivery arm 500 is retrieving, centering, and stabbing the next tubular stand 80. This allows independent and simultaneous movement of, for tripping out, retractable top drive assembly 200 raises the drill string from the well (set slips), disengages the drill string, retracts, and travels vertically down mast 10 while tubular delivery arm 500 centers for disengaging the top drive 200, hoists and moves the tubular stand 80 away for racking. This combined capability makes greatly accelerated trip speeds possible. The limited capacity of tubular delivery arm 500 to lift stands of drill pipe allows the weight of tubular delivery arm 500 to be minimized, if properly designed. Tubular delivery arm 500 can be raised and lowered along mast 10 with only an electric crown winch, for example.

Figure 17:
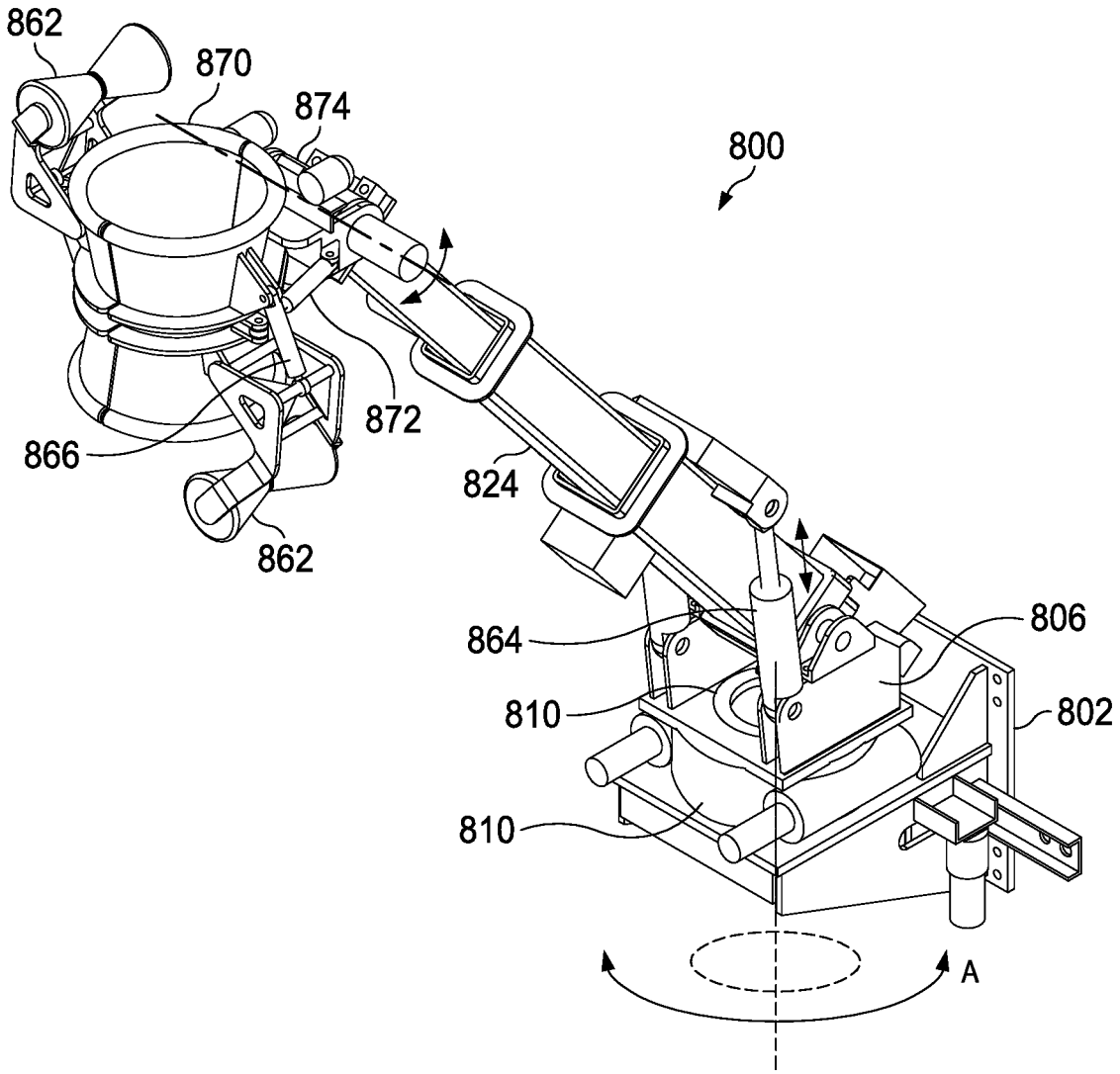
FIG. 17 is an isometric view of an embodiment of a lower stabilizing arm component of the disclosed embodiments, illustrating the multiple exendable sections of the arm that are pivotally and rotatable mounted to the base for connection to a lower portion of a drilling mast.

FIG. 17 is an isometric view of an embodiment of a lower stabilizing arm 800, illustrating the rotation, pivot, and extension of an arm assembly 824. In this embodiment, arm assembly 824 is pivotally and rotationally connected to a mast bracket 802. An arm bracket 806 is rotationally connected to mast bracket 802. Arm assembly 824 is pivotally connected to arm bracket 806. A pivot actuator 864 controls the pivotal movement of arm assembly 824 relative to arm connection bracket 806 and thus mast bracket 802. A rotary table 810 controls the rotation of arm assembly 824 relative to arm connection bracket 806 and thus mast bracket 802. Arm assembly 824 is extendable as shown.

In this embodiment, a tubular guide 870 is rotationally and pivotally connected to arm assembly 824. A pivot actuator 872 controls the pivotal movement of tubular guide 870 relative to arm assembly 824. A rotate actuator 874 controls the rotation of tubular guide 870 relative to arm assembly 824. A pair of V-rollers 862 is provided to center a tubular stand 80 in guide 870. V-rollers 862 are operable by a roller actuator 866.

Figure 18:
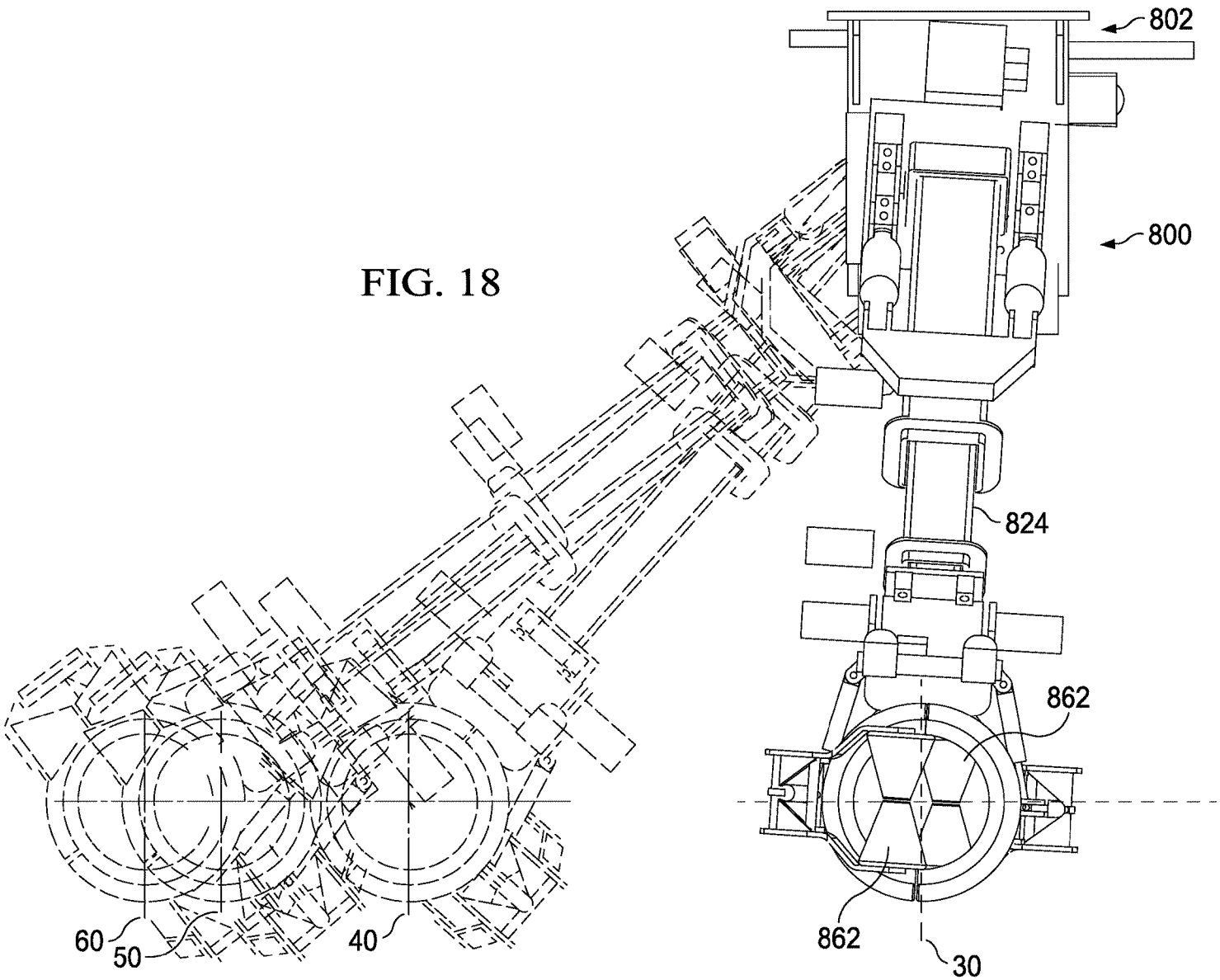
FIG. 18 is a side view of the embodiment of FIG. 16, illustrating positioning of the lower stabilizing arm to stabilize the lower portion of a tubular stand between a well center, mousehole, stand hand-off and catwalk position.

The operation of the various rotational and pivot controls permits placement of tubular guide 870 over center of each of a wellbore 30, a mousehole 40, and a stand hand-off position 50 of drilling rig 1 as seen best in FIG. 18.

FIG. 18 is a top view of an embodiment of a lower stabilizing arm 800, illustrating the change in positioning that occurs as lower stabilizing arm 800 relocates between the well center position 30, mousehole position 40, stand hand-off position 50, and catwalk position 60.

Figure 19:
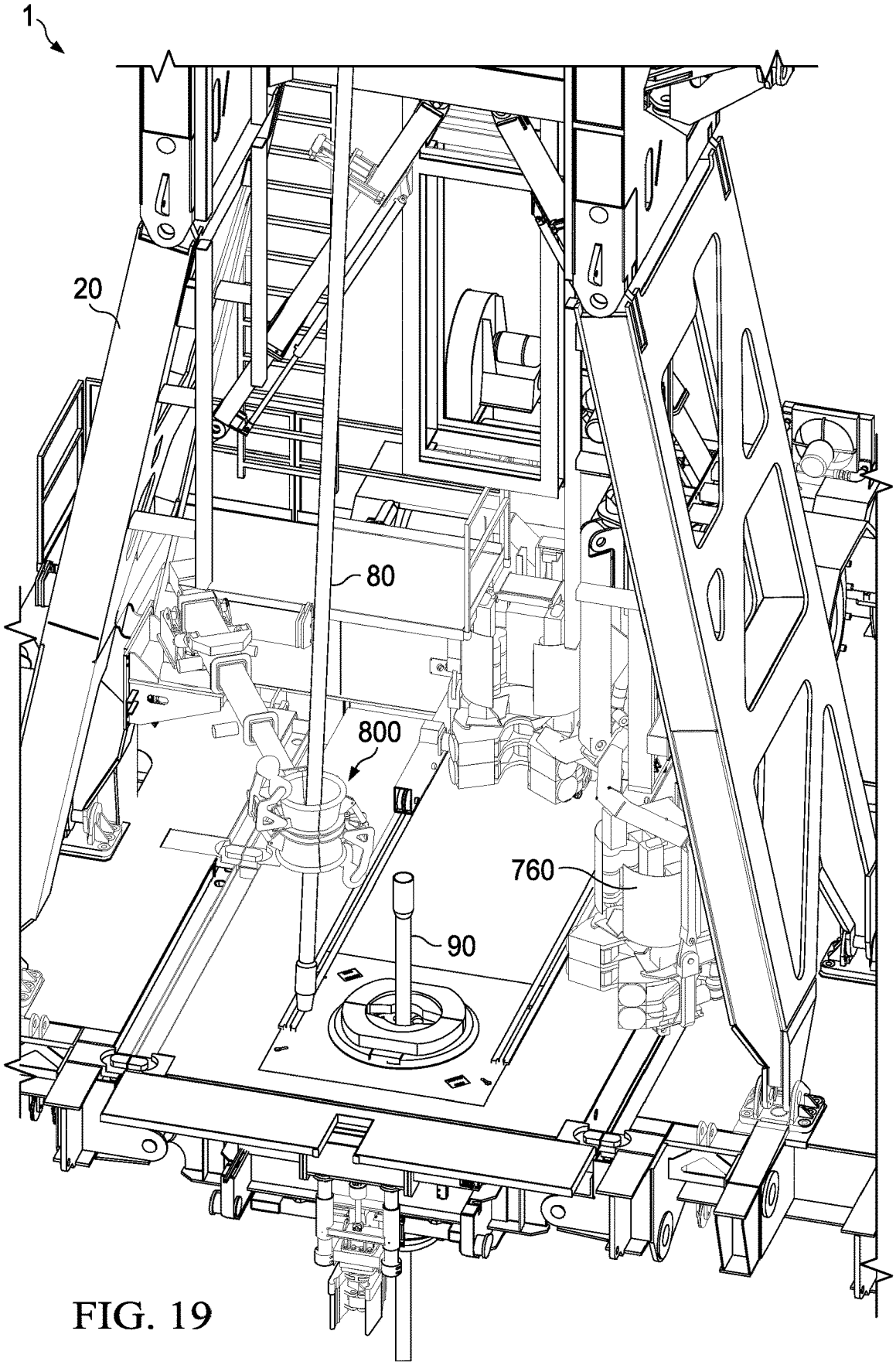
FIG. 19 is an isometric view of the embodiment of FIG. 18, illustrating the lower stabilizing arm guiding the lower end of a drill pipe section near the well center.

FIG. 19 is an isometric view of lower stabilizing arm 800 connected to a leg 20 of drilling rig 1, illustrating lower stabilizing arm 800 capturing the lower end of tubular stand 80 and guiding tubular stand 80 to well center 30 for stabbing into drill string 90 (or to stand hand-off position 50 for racking). Once stabbed, iron roughneck 760 will connect the tool joints.

Figure 20:
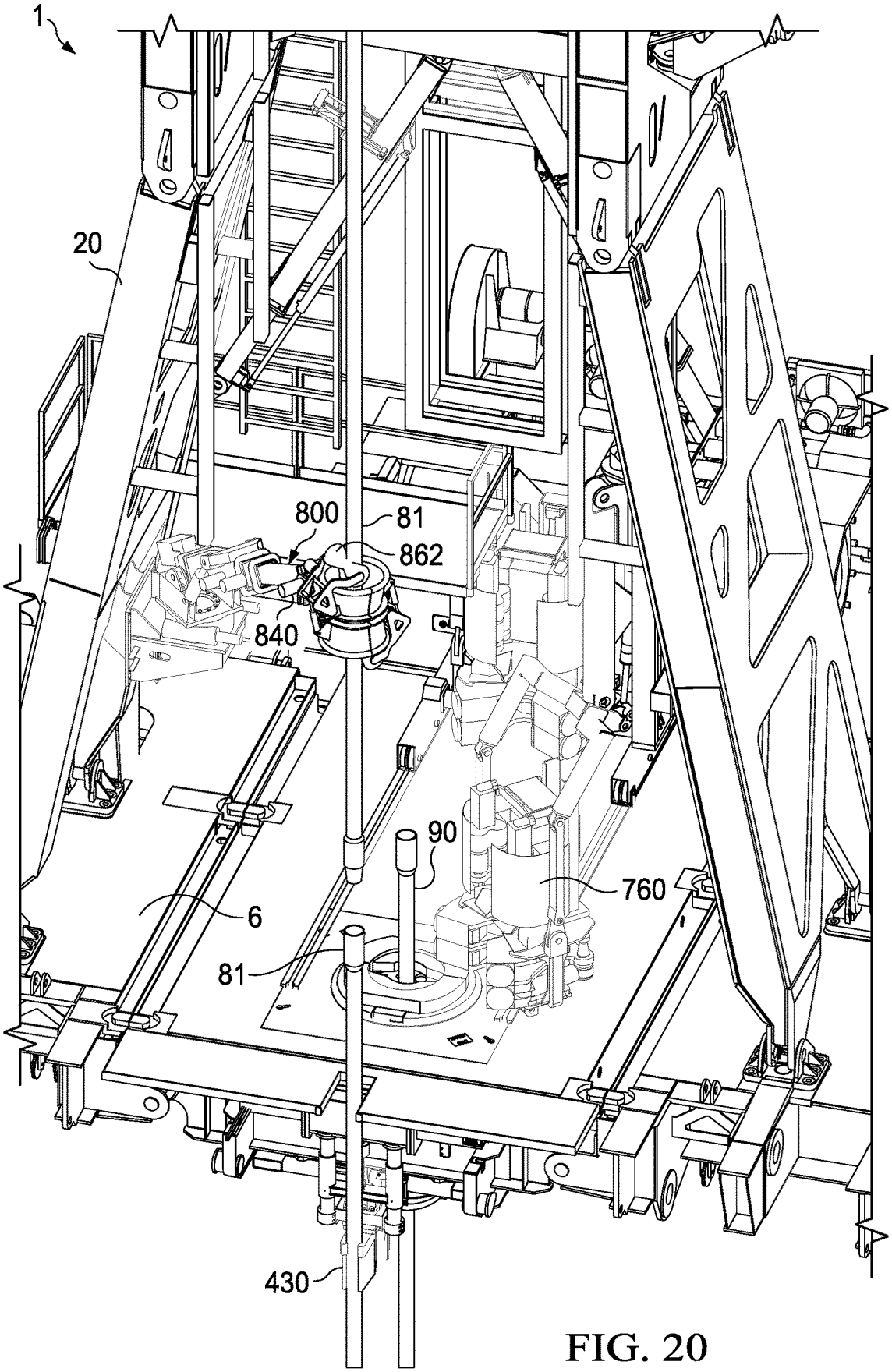
FIG. 20 is an isometric view of an embodiment of the lower stabilizing arm, illustrated secured to the lower end of a stand of drill pipe and stabbing it at the mousehole.

FIG. 20 illustrates lower stabilizing arm 800 secured to the lower end of tubular section 81 and preparing to stab it into the box connection of tubular section 81 located in mousehole 40 in a stand building procedure (or after breaking the two sections 81 apart). In FIG. 20, tubular section 81 in mousehole 40 is secured to drill floor 6 by a tubular gripping assembly 409 (see FIG. 21) of intermediate stand constraint 430.

As illustrated and described above, lower stabilizing arm 800 is capable of handling the lower end of tubular stand 80 and tubular sections 81 to safely permit the accelerated movement of tubular stands for the purpose of reducing trip time and connection time, and to reduce exposure of workers on drill floor 6. Lower stabilizing arm 800 provides a means for locating the pin end of a hoisted tubular stand 80 into alignment with the box end of another for stabbing, or for other positional requirements such as catwalk retrieval, racking, mousehole insertion, and stand building and breakout. Lower stabilizing arm 800 can accurately position a tubular stand 80 at wellbore center position 30, mousehole position 40, and stand hand-off position 50 of drilling rig 1.

Figure 21:
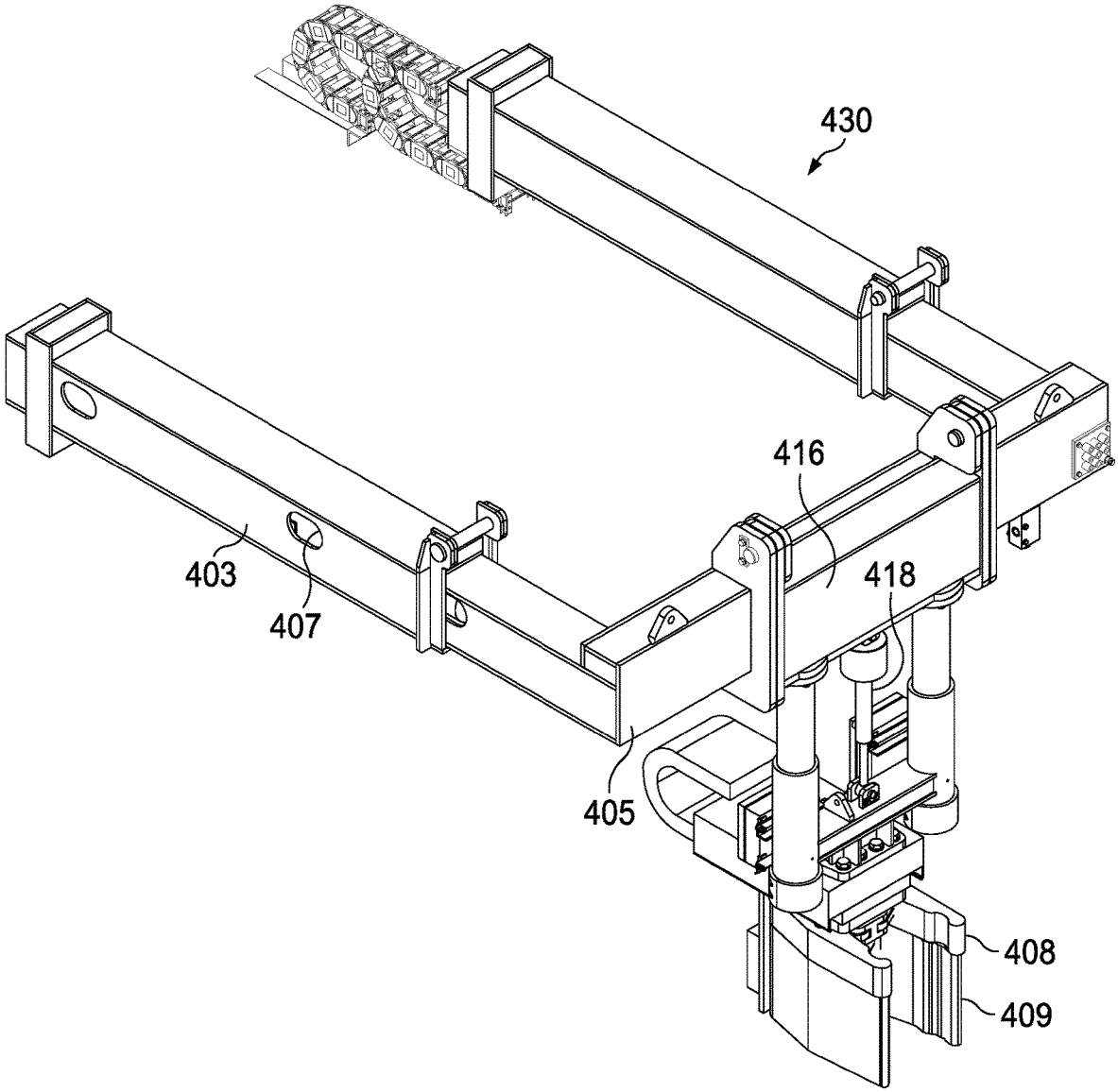
FIG. 21 is an isometric view of an embodiment of an intermediate stand constraint, illustrated extended.

FIG. 21 is an isometric view of an embodiment of an intermediate stand constraint 430. Intermediate stand constraint 430 as shown can be connected at or immediately beneath drill floor 6, as illustrated in FIG. 20. Intermediate stand constraint 430 has a frame 403 that may be configured as a single unit or as a pair of members, as illustrated. A carriage 405 is extendably connected to frame 403. In the view illustrated, carriage 405 is extended from frame 403. A carriage actuator 407 is connected between frame 403 and carriage 405 and is operable to extend and retract carriage 405 from frame 403.

A clasp 408 is pivotally connected to the end of carriage 405, and a clasp actuator (not visible) is operable to open and close clasp 408. Clasp 408 is preferably self-centering to permit closure of clasp 408 around a full range of drilling tubulars 80, including casing, drill collars and drill pipe. Clasp 408 is not required to resist vertical movement of tubular stand 80. In one embodiment, clasp 408 comprises opposing claws.

The tubular gripping assembly 409 is capable of supporting the vertical load of tubular stand 80 to prevent downward vertical movement of tubular stand 80. In the embodiment shown, a transport bracket 416 is pivotally connected to carriage 405. An actuator 418 is provided to adjust the height of clasp 408 and gripper 409.

Figure 22:
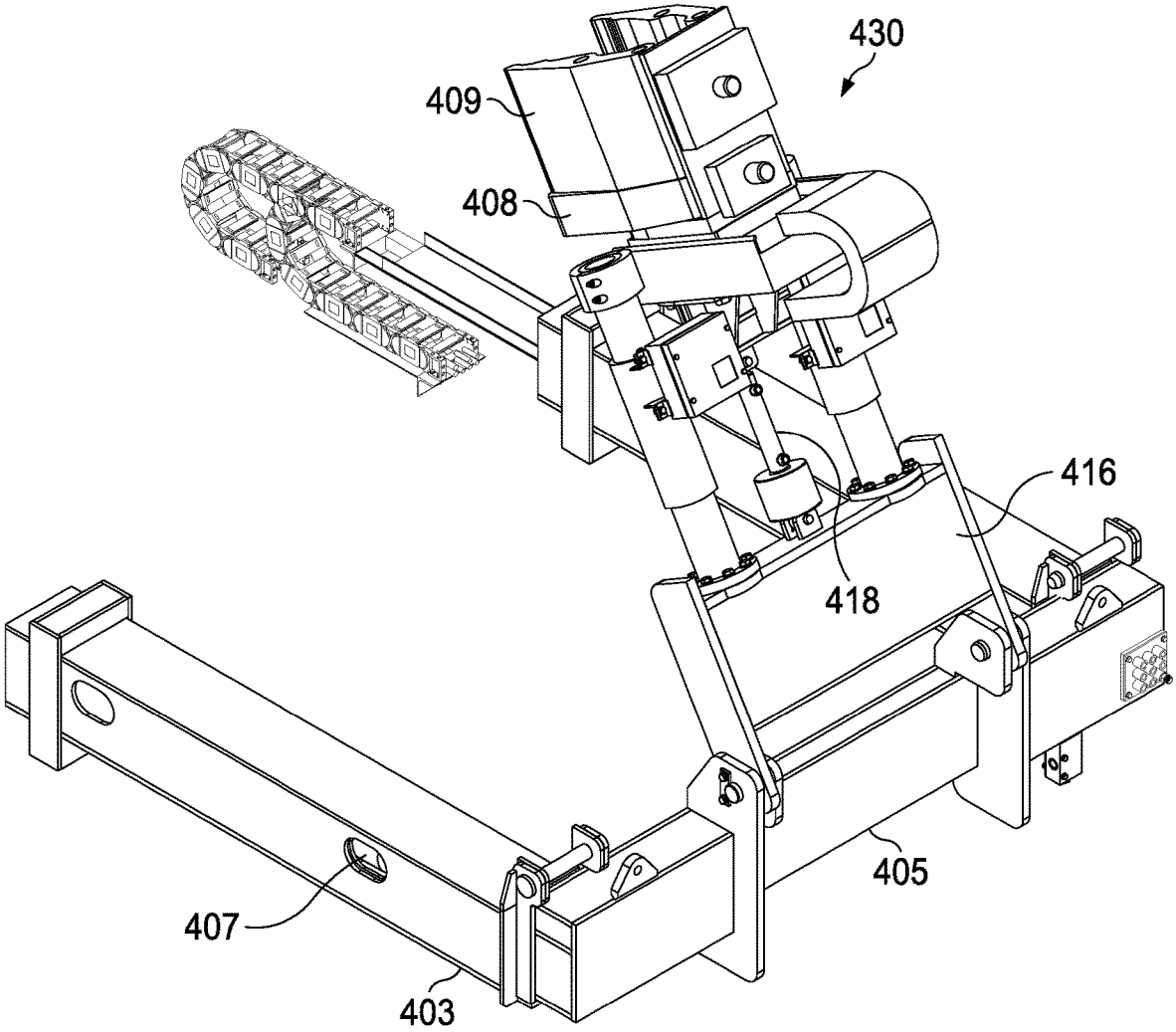
FIG. 22 is an isometric view of the embodiment of the intermediate stand constraint of FIG. 21, illustrating the intermediate stand constraint folded for transportation between drilling locations.

FIG. 22 is an isometric view of the embodiment of intermediate stand constraint 430 of FIG. 21, illustrating carriage 405 retracted, and transport bracket 416 pivoted into a transport position.

In operation, intermediate stand constraint 430 can facilitate stand building at mousehole 40. For example, intermediate stand constraint 430 may be used to vertically secure a first tubular section 81 (see FIG. 20). A second tubular section 81 may then be positioned in series alignment by a hoisting mechanism such as the tubular delivery arm 500. With the use of an iron roughneck 760 (see FIGS. 19 and 20) movably mounted at drill floor 6, the series connection between the first and second tubular sections 81 can be made to create a double tubular stand 80. Gripping assembly 409 can then be released to permit the double tubular stand 80 to be lowered into mousehole 40. Gripping assembly 409 can then be actuated to hold double tubular stand 80 in centered position, as a third tubular section 81 is hoisted above and stabbed into double tubular section 81. Once again, iron roughneck 760 on drill floor 6 can be used to connect the third tubular section 81 and form a triple tubular stand 80.

Figure 23:
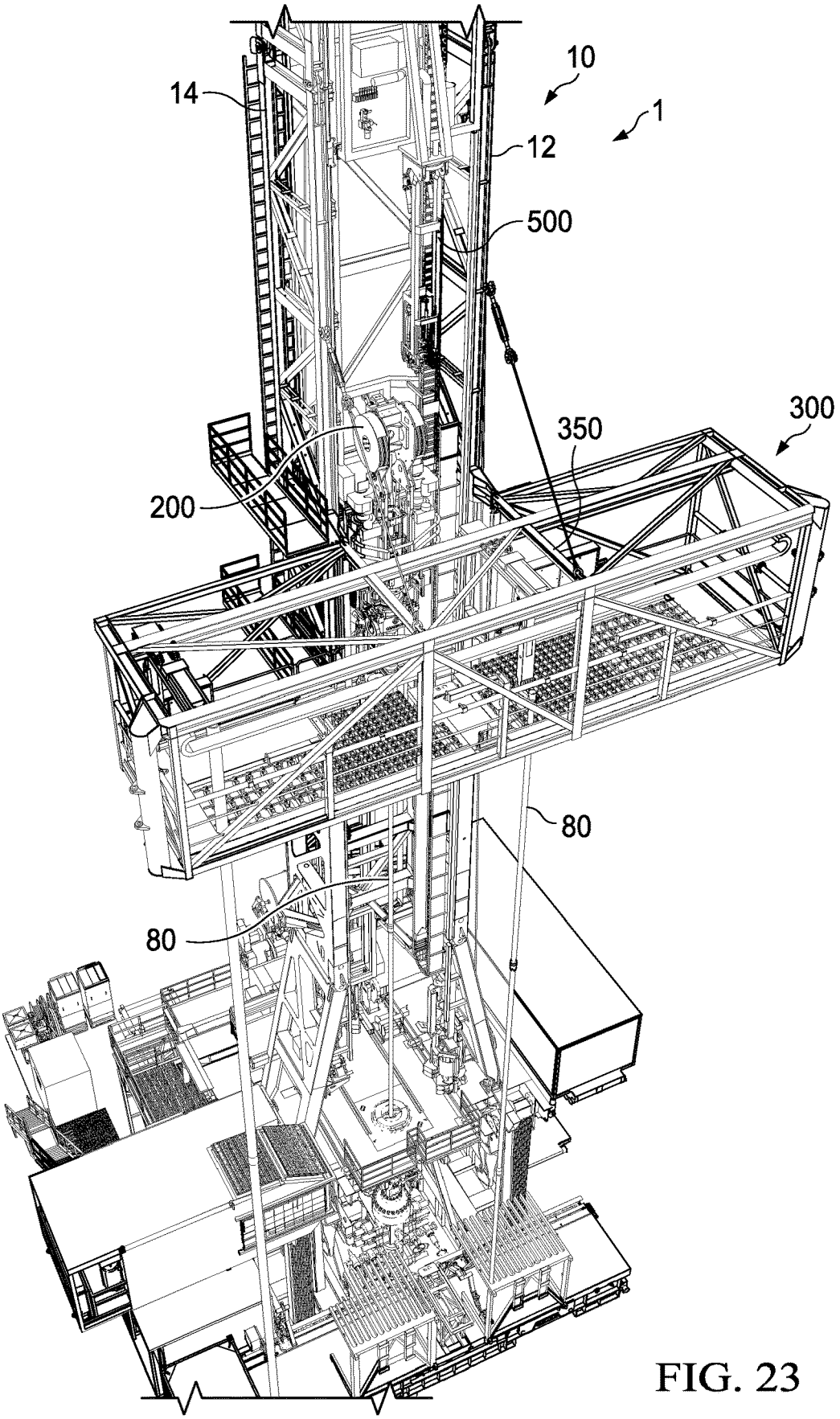
FIG. 23 is an isometric view illustrating an embodiment of the high trip rate drilling rig showing the tubular delivery arm positioned over the stand hand-off position and vertically elevated with respect to the retractable top drive assembly.
Figure 24:
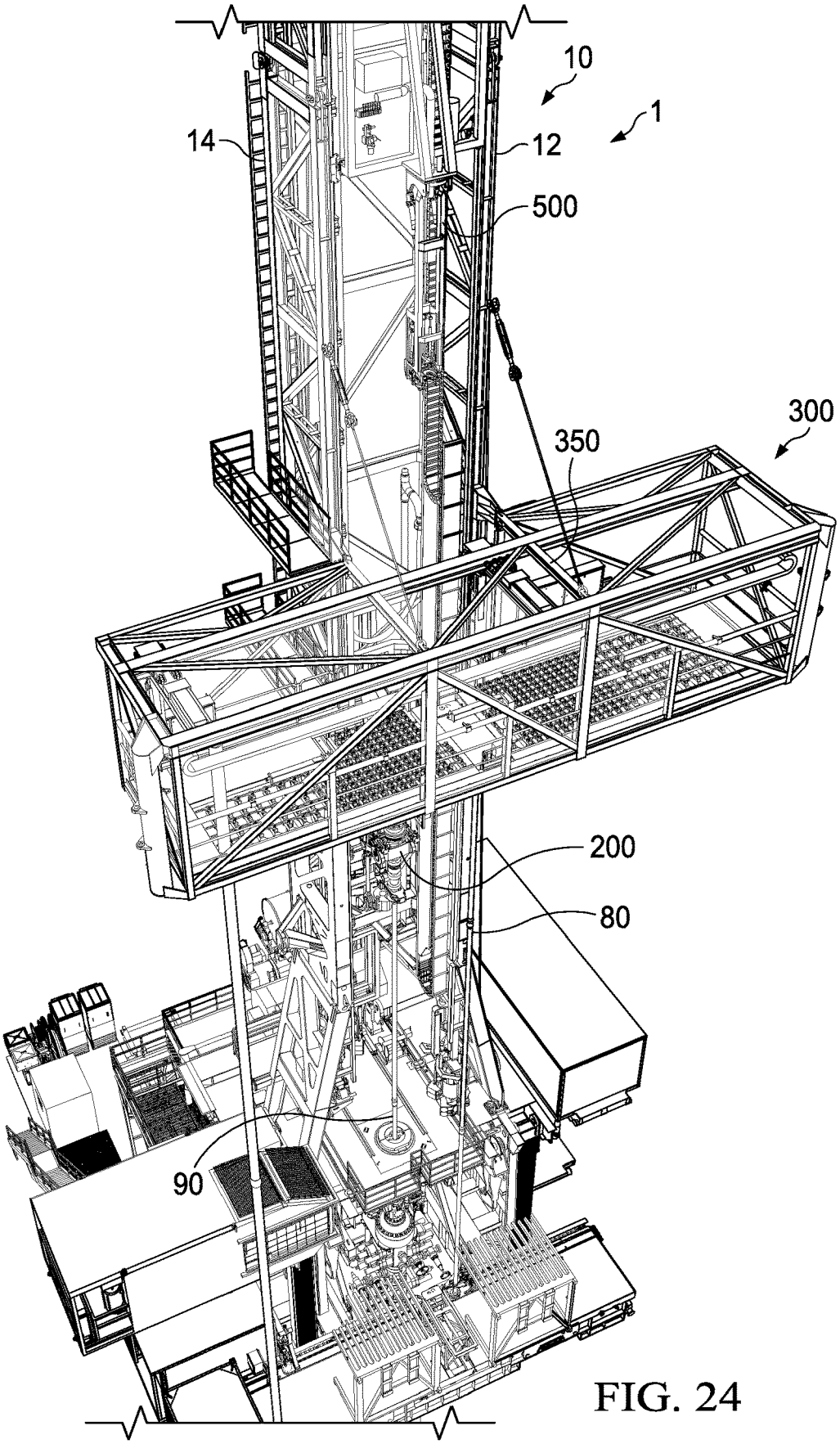
FIG. 24 is an isometric view illustrating an embodiment of the high trip rate drilling rig showing the retractable top drive assembly lowering or raising the drill string over the well, and the upper racking arm is moving a tubular stand between a racked position and the stand hand-off position.
Figure 25:
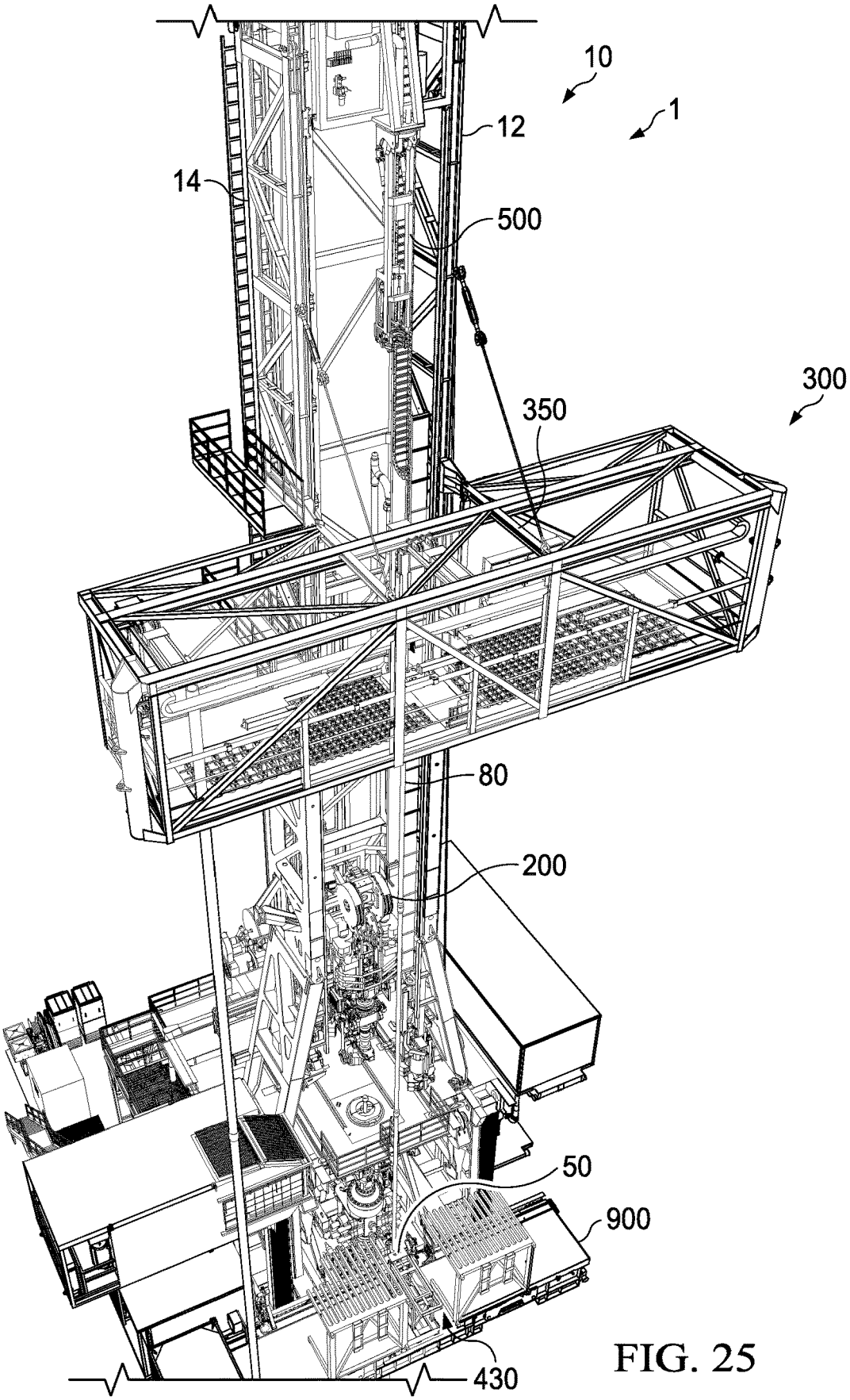
FIG. 25 is an isometric view illustrating an embodiment of the high trip rate drilling rig showing the retractable top drive assembly near the position where automatic slips will engage or have just disengaged drill string, and the tubular delivery arm near the stand hand-off position.

FIGS. 23-25 illustrate an embodiment of high trip rate drilling rig 1 in the tripping in process of moving tubular stands 80 from racking module 300 to well center 30 for placement into the well, and/or the tripping out process of moving the tubular stands from well center 30 to racking module 300. To keep the drawings readable, some items mentioned below may not be numbered in FIGS. 23-25, and reference may be made to FIGS. 1-22 for the additional details.

FIG. 23 shows tubular delivery arm 500 on a front side 12 of mast 10 in an unarticulated position above racking module 300 on front side 12 of mast 10. In this position, tubular delivery arm 500 has the tubular clasp 550 facing the stand hand-off position 50, and is vertically elevated above retractable top drive assembly 200 and racking module 300. Tubular stand 80 is connected to the drill string in the well (not visible) and is now a component of drill string 90 (see FIG. 19). Tubular stand 80 and the rest of drill string 90 are held by retractable top drive assembly 200, which is articulated into its well center position 30, and is descending along mast 10 downward towards (or ascending away from) drill floor 6.

In FIG. 24, retractable top drive assembly 200 has descended further towards drill floor 6 as it lowers drill string 90 (see FIG. 19) into the well (or is earlier in its ascent for tripping out). Upper racking arm 350 is moving the next tubular stand 80 from its racked position towards stand hand-off position 50 (or away from stand hand-off position 50 for racking).

In FIG. 25, retractable top drive assembly 200 is near the position where automatic slips will engage drill string 90 (see FIG. 19). Tubular delivery arm 500 is positioned lower down front side 12 of mast 10 near stand hand-off position 50. Upper racking arm 350 and lower racking arm 950 (see FIG. 34) have delivered tubular stand 80 to (or are retrieving it from) stand hand-off position 50. Upper stand constraint 420 (see FIG. 11) and lower stand constraint 440 have secured tubular stand 80 at stand hand-off position 50.

Figure 26:
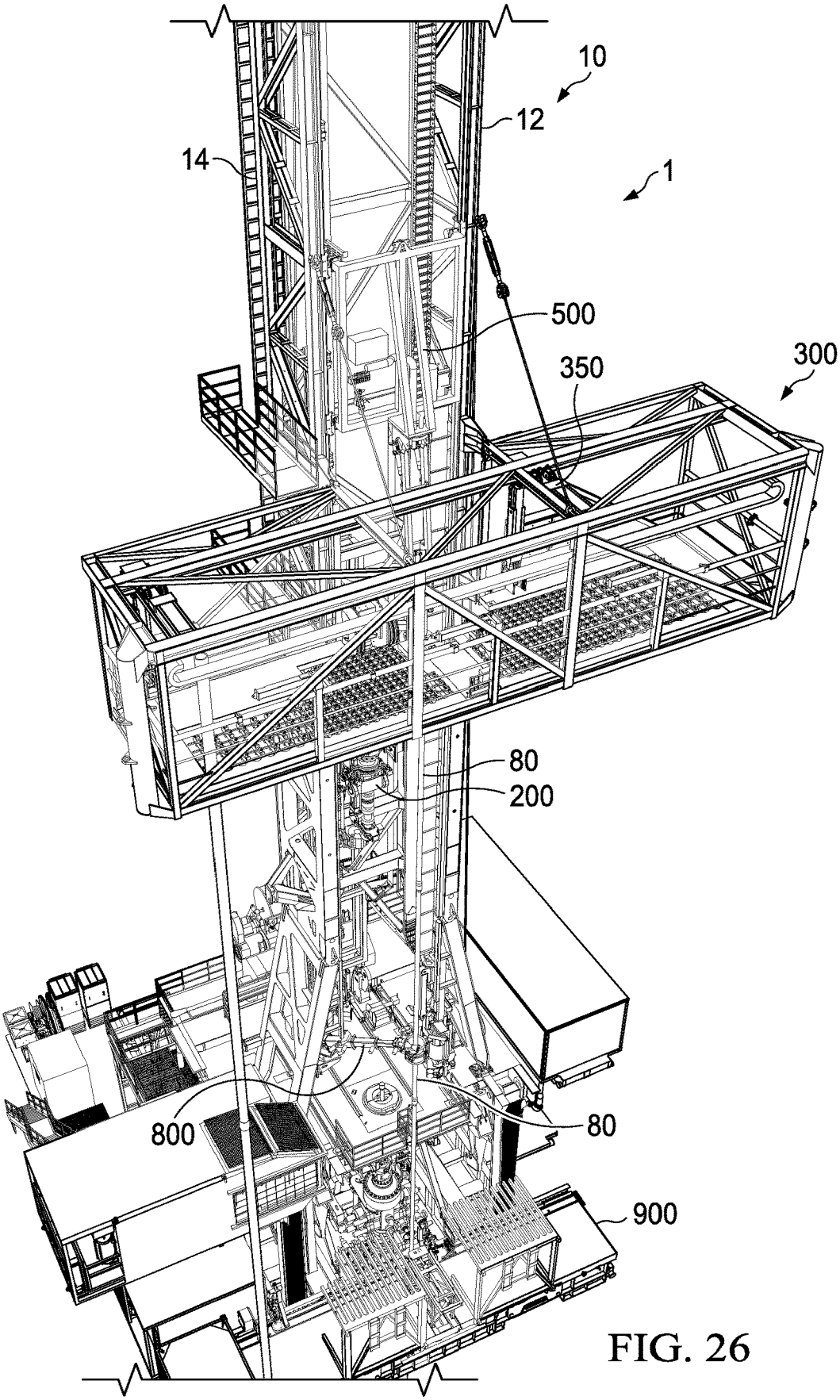
FIG. 26 is an isometric view illustrating an embodiment of the high trip rate drilling rig showing the retractable top drive assembly in the retracted position behind well center, tubular delivery arm facing the stand hand-off position and clasping a tubular stand, and lower stabilizing arm guiding the lower end of the tubular stand.

In FIG. 26, automatic slips have engaged drill string 90 (see FIG. 19) and retractable top drive assembly 200 has released (or is approaching) tubular stand 80. Retractable top drive assembly 200 is in the retracted position for its return path behind well center 30 and proximate to the rear side 14 of mast 10. Tubular delivery arm 500 has articulated its arm member 532 to the stand hand-off position 50, and tubular clasp 550 is latched onto tubular stand 80. Near drill floor 6, lower stabilizing arm 800 has engaged the lower end of tubular stand 80. Upper stand constraint 420 (FIG. 11) is opened to release (or receive) tubular stand 80.

Figure 27:
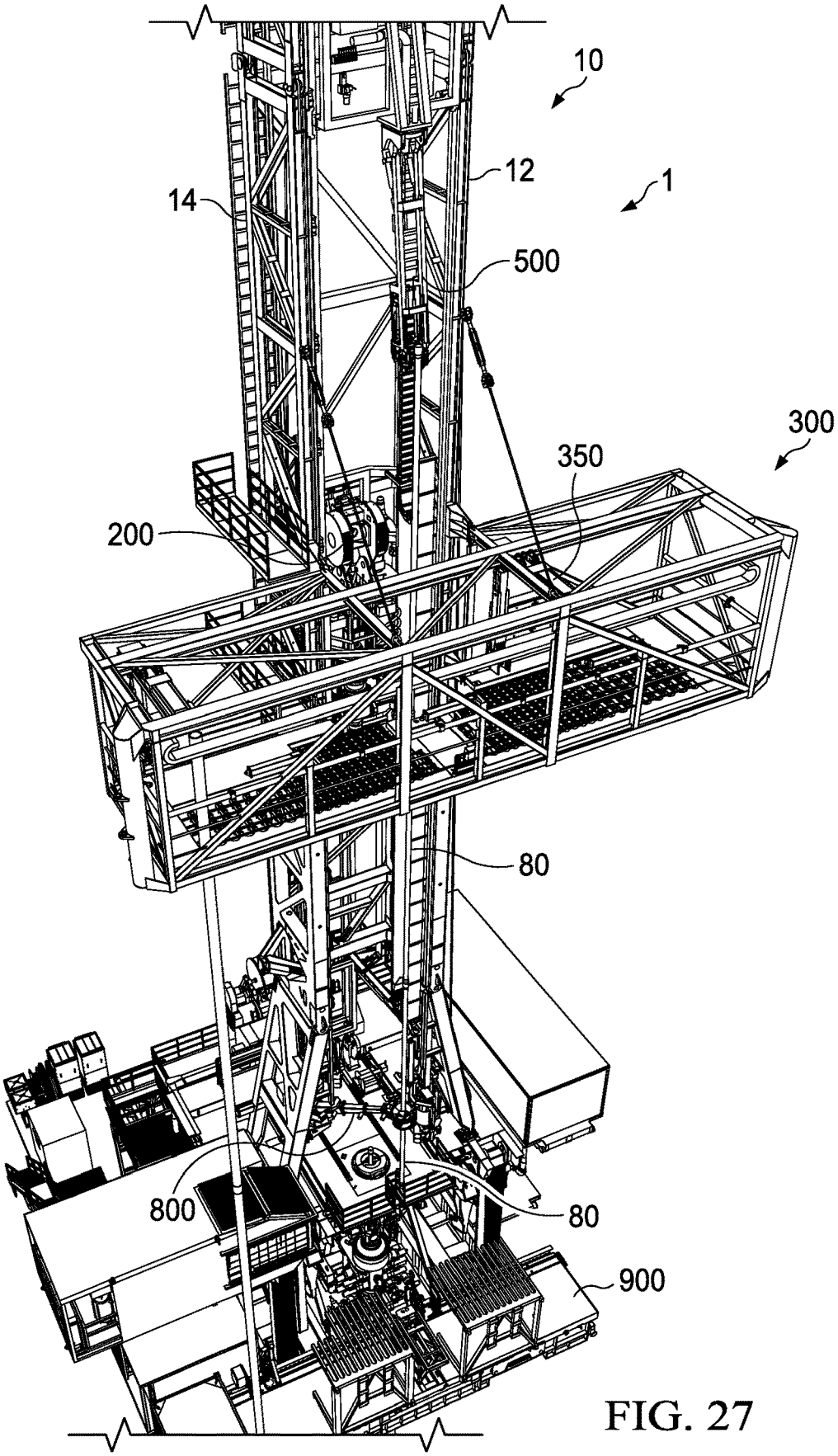
FIG. 27 is an isometric view illustrating an embodiment of the high trip rate drilling rig showing the top drive assembly retracted between the top and the bottom of the mast, and the tubular delivery arm facing the hand-off position and clasping the tubular stand.

In FIG. 27, retractable top drive assembly 200 has begun a retracted ascent to (or is completing retracted descent from) the top of mast 10. Tubular delivery arm 500 has also risen (or lowered) along the front side 12 of mast 10. With this motion, clasp 550 of tubular delivery arm 500 has engaged the upset of tubular stand 80 and lifted tubular stand 80 vertically off (or is lowering it onto) setback platform 900. Lower stabilizing arm 800 is supporting the lower end of tubular stand 80.

Figure 28:
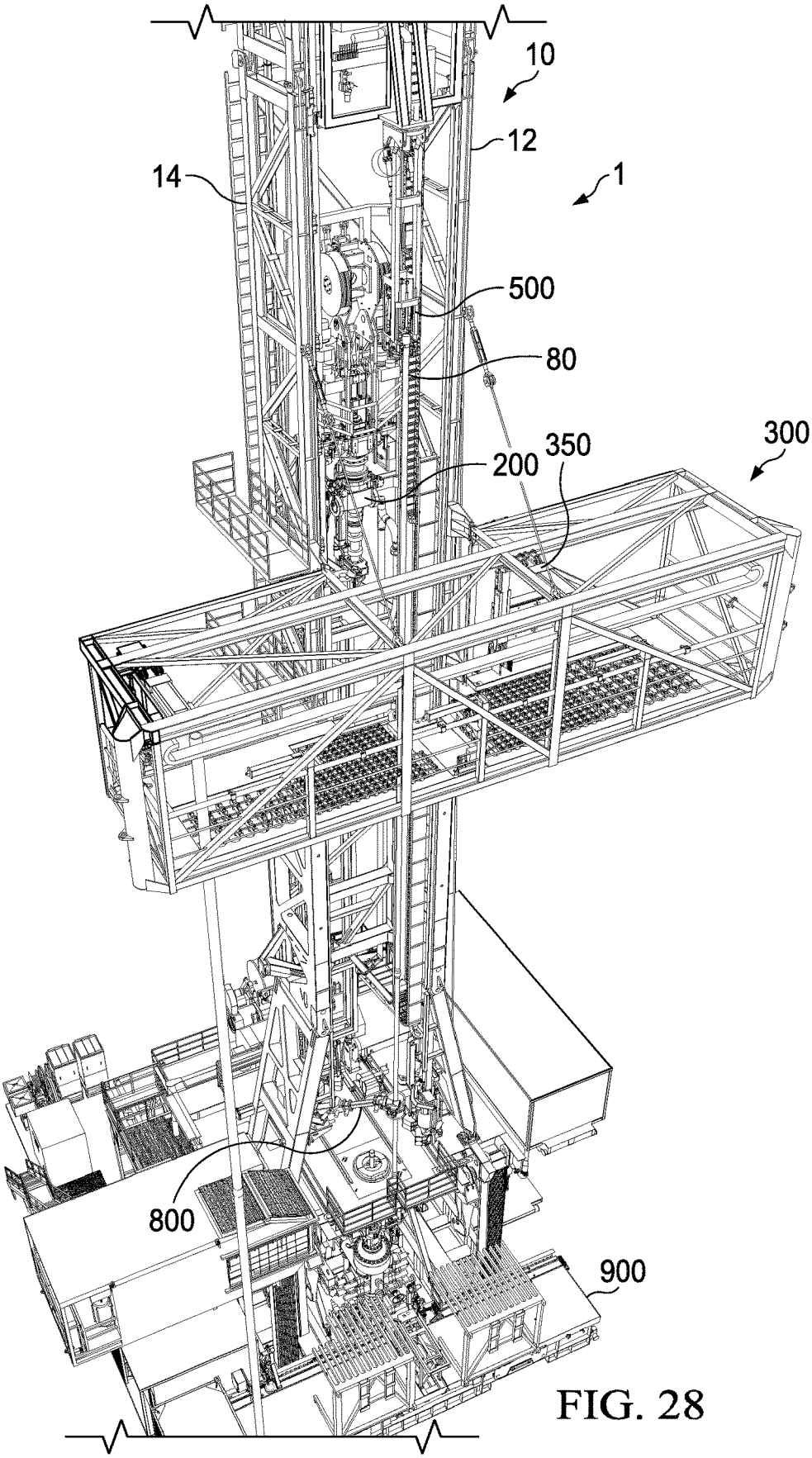
FIG. 28 is an isometric view illustrating an embodiment of the high trip rate drilling rig showing the top drive assembly retracted near the top of the mast, and the tubular delivery arm clasping the tubular stand to elevate the lower end above the stump of the drill above the drill floor.

In FIG. 28, retractable top drive assembly 200 continues its retracted ascent up (or descent down) mast 10. Tubular delivery arm 500 has elevated sufficiently to insure the bottom of tubular stand 80 will clear the stump of drill string 90 extending above drill floor 6 (or has raised tubular stand 80 following break out from the drill string 90). Since releasing tubular stand 80 at stand hand-off position 50 (or in the racking module 350), upper racking arm 350 has been free to move to and secure the next tubular stand in sequence.

Figure 29:
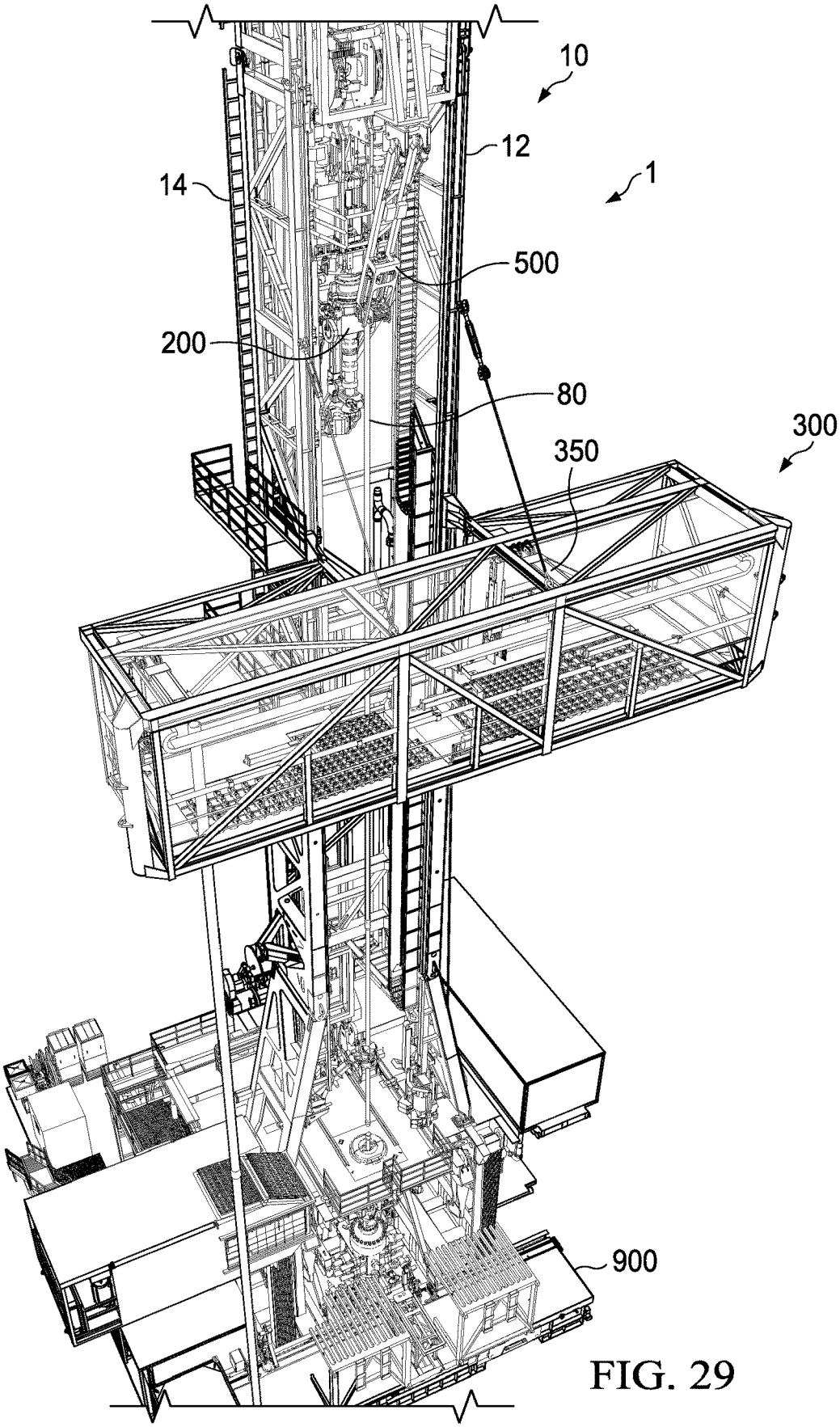
FIG. 29 is an isometric view illustrating an embodiment of the high trip rate drilling rig showing the top drive assembly higher up on the mast, and the tubular delivery arm facing rearward and clasping the tubular stand over the stump.

In FIG. 29, retractable top drive assembly 200 continues its retracted ascent up (or descent down) mast 10. Tubular delivery arm 500 has rotated 180 degrees, such that the opening on clasp 550 is facing well center 30. After rotation, tubular delivery arm 500 has been articulated to position tubular stand 80 over well center 30. (Or the tubular delivery arm 500 has hoisted tubular stand 80 above the drill string at well center position 30.)

Figure 30:
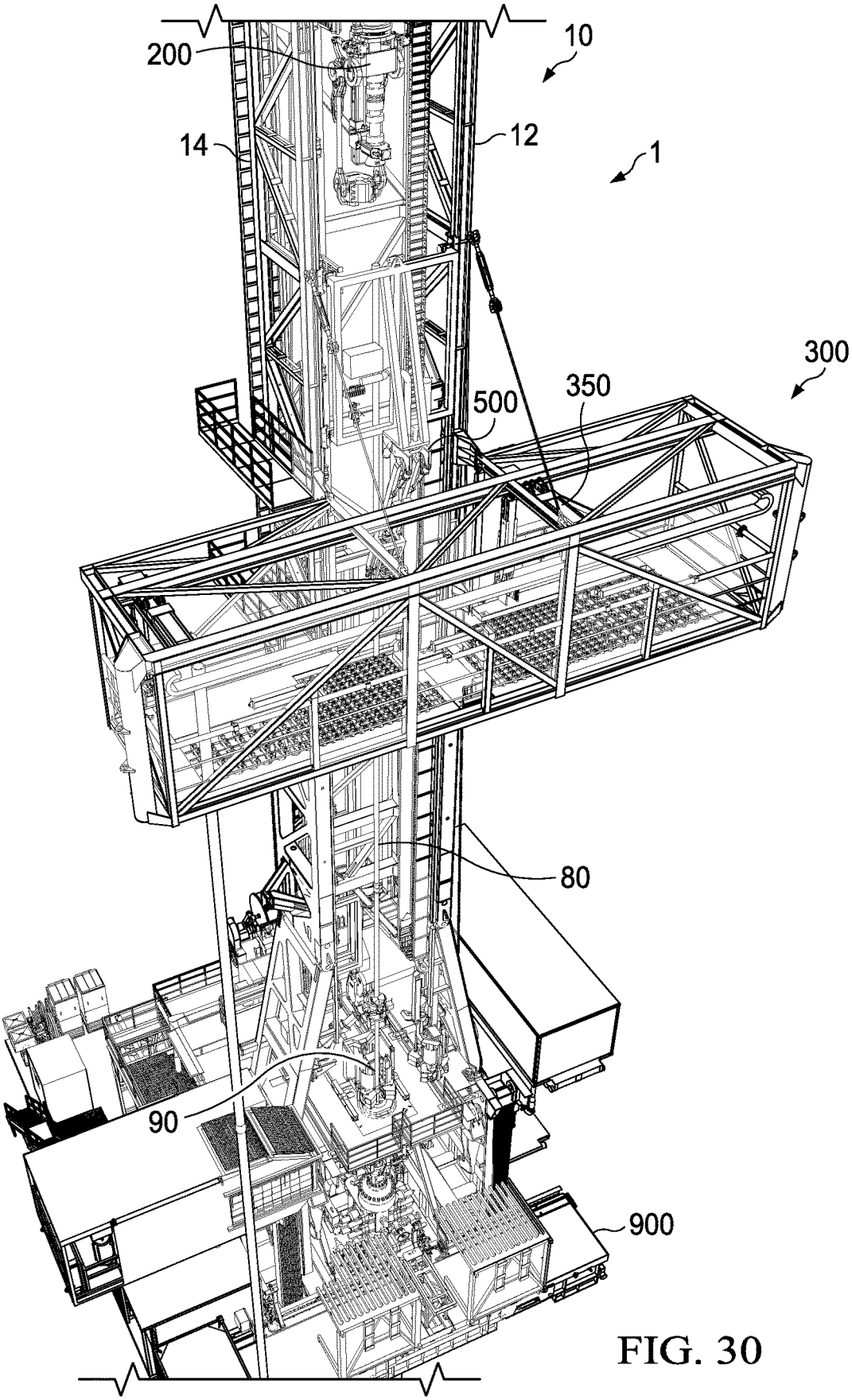
FIG. 30 is an isometric view illustrating an embodiment of the high trip rate drilling rig showing the top drive assembly extended over well center over the upper end of the tubular stand, and the tubular delivery arm clasping the tubular stand below the upper end.

In FIG. 30, tubular delivery arm 500 has descended its path on the front side 12 of mast 10 until tubular stand 80, with guidance from lower stabilizing arm 800, has stabbed the pin connection of its lower tool joint into the box connection of the exposed tool joint of drill string 90 (or tubular delivery arm 500 was engaging the upper end of the tubular stand 80 in preparation to hoist it after break out from the drill string 90). Tubular delivery arm 500 continues to descend such that clasp 550 moves lower on tubular stand 80 to make room for retractable top drive assembly 200 (or tubular delivery arm 500 has centered tubular stand 80 at well center position 30 for disengagement of the top drive 200, and is preparing to ascend to hoist the stand 80 from the upset).

Retractable top drive assembly 200 has risen to a position on mast 10 that is fully above tubular delivery arm 500. Having cleared tubular delivery arm 500 and tubular stand 80 in its ascent, retractable top drive assembly 200 has expanded actuator 220 to extend retractable top drive assembly 200 to its well center 30 position, directly over tubular stand 80, and is now descending to engage the top of tubular stand 80 (or has been raised up after breaking out from the tubular stand 80 and is preparing to retract and descend)).

Figure 31:
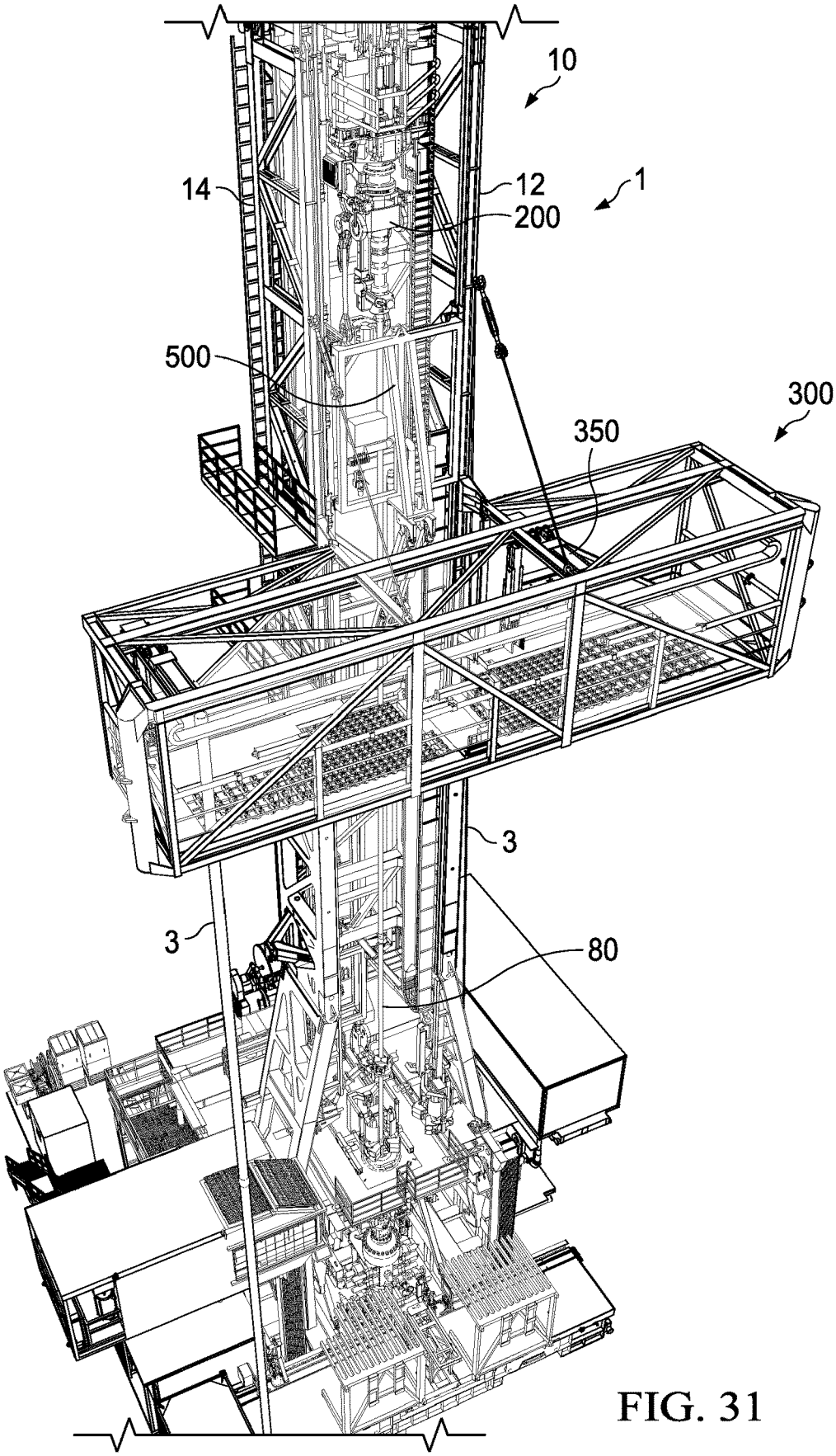
FIG. 31 is an isometric view illustrating an embodiment of the high trip rate drilling rig showing the top drive assembly extended over well center to make or break connection to the upper end of the tubular stand, and the tubular delivery arm clasping the upper portion of the tubular stand below the top drive.

In FIG. 31, retractable top drive assembly 200 has engaged (or is disengaging) tubular stand 80 as centered by tubular delivery arm 500 at the top and lower stabilizing arm 800 at the bottom. Retractable top drive assembly 200 can now rotate to make-up and fully torque (or counter-rotate to break out) the connection. An iron roughneck at drill floor 6 may be used to secure (or break out) the connection between the drill string 90 and tubular stand 80.

Figure 32:
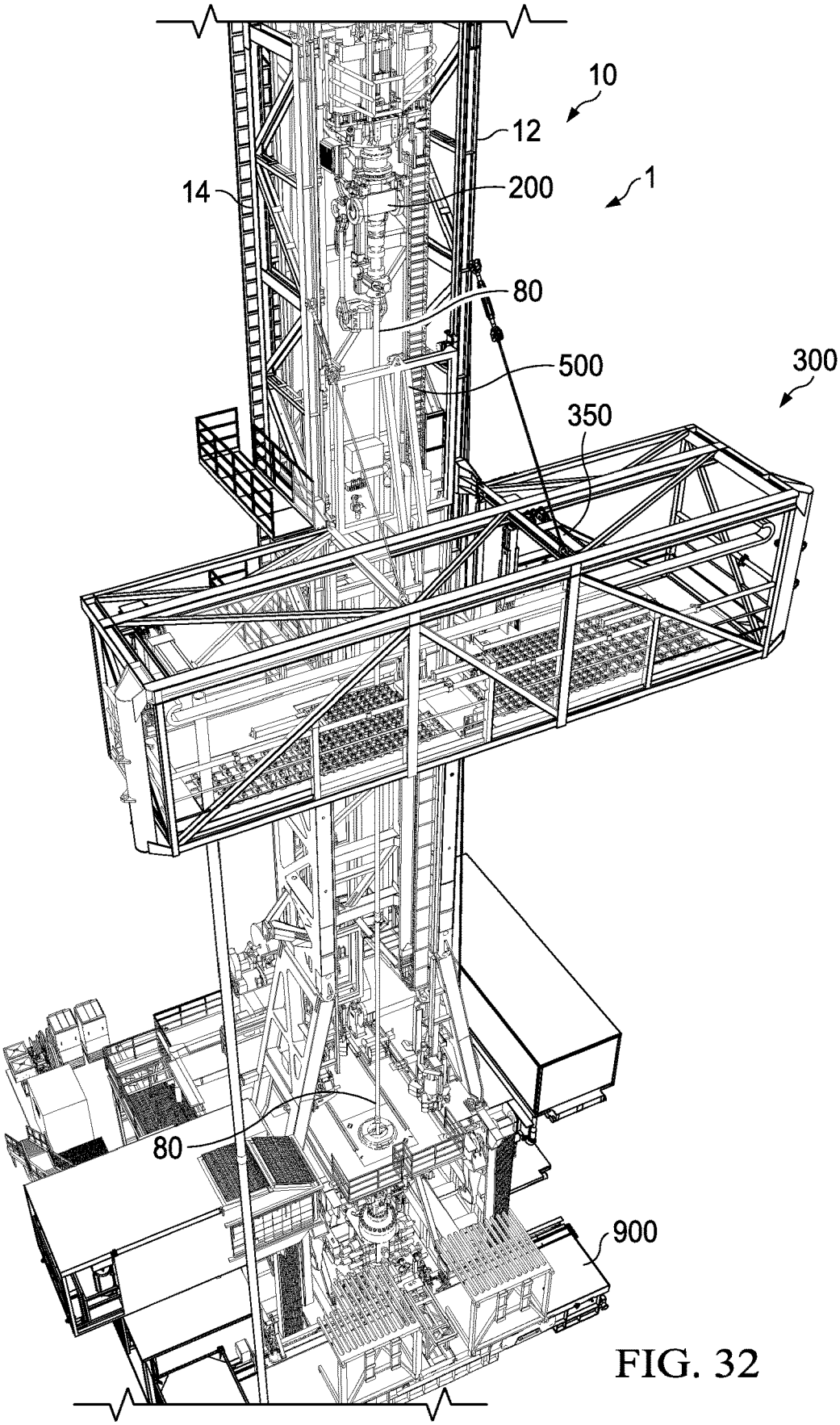
FIG. 32 is an isometric view illustrating an embodiment of the high trip rate drilling rig showing lower stabilizing arm and tubular delivery arm disengaged from the tubular stand, the tubular deliver arm positioned between well center and the stand hand-off position to retrieve another tubular stand, and the top drive assembly supporting the weight of the drill string.

In FIG. 32, lower stabilizing arm 800 and tubular delivery arm 500 have released tubular stand 80 and retracted from (or preparing to extend to) well center 30. In the non-actuated position, tubular delivery arm 500 has rotated to allow clasp 550 to again face stand hand-off position 50 (or is preparing to rotate to face well center 30) in anticipation of receiving the next tubular stand 80. Retractable top drive assembly 200 now supports the weight of the drill string as the automatic slips have also released, and retractable top drive assembly 200 is beginning its descent to lower drill string 90 into (or nearing the top of its ascent to raise tubular stand 80 connected to drill string 90 from) the wellbore.

Figure 33:
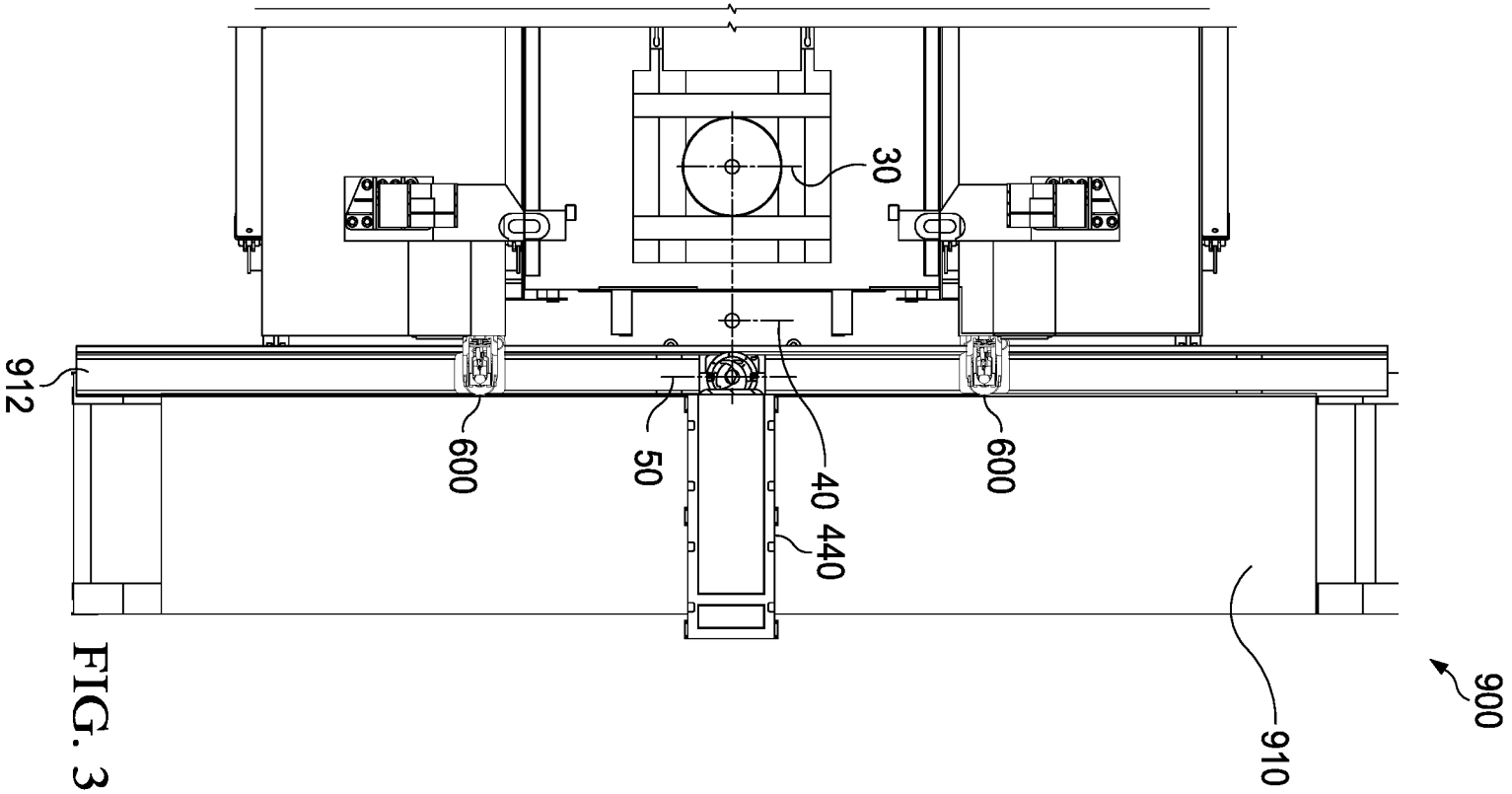
FIG. 33 is a top view of an embodiment of a setback platform of the tubular racking system of the disclosed embodiments.

FIG. 33 is a top view of setback platform 900 on which the tubular stands 80 are stacked in accordance with their respective positions in the fingerboard assembly 310. Drilling rig 1, catwalk 600 and tubular stands 80 are removed for clarity. This embodiment illustrates the relationship between well center 30, mousehole 40, and stand hand-off position 50. As seen in this view, an alleyway 912 is provided on the front edge of setback platform 900. Stand hand-off position 50 is located in alleyway 912, in alignment with mousehole 40 and well center 30. A pair of lower racking arms 950 is also located in alleyway 912.

Figure 34:
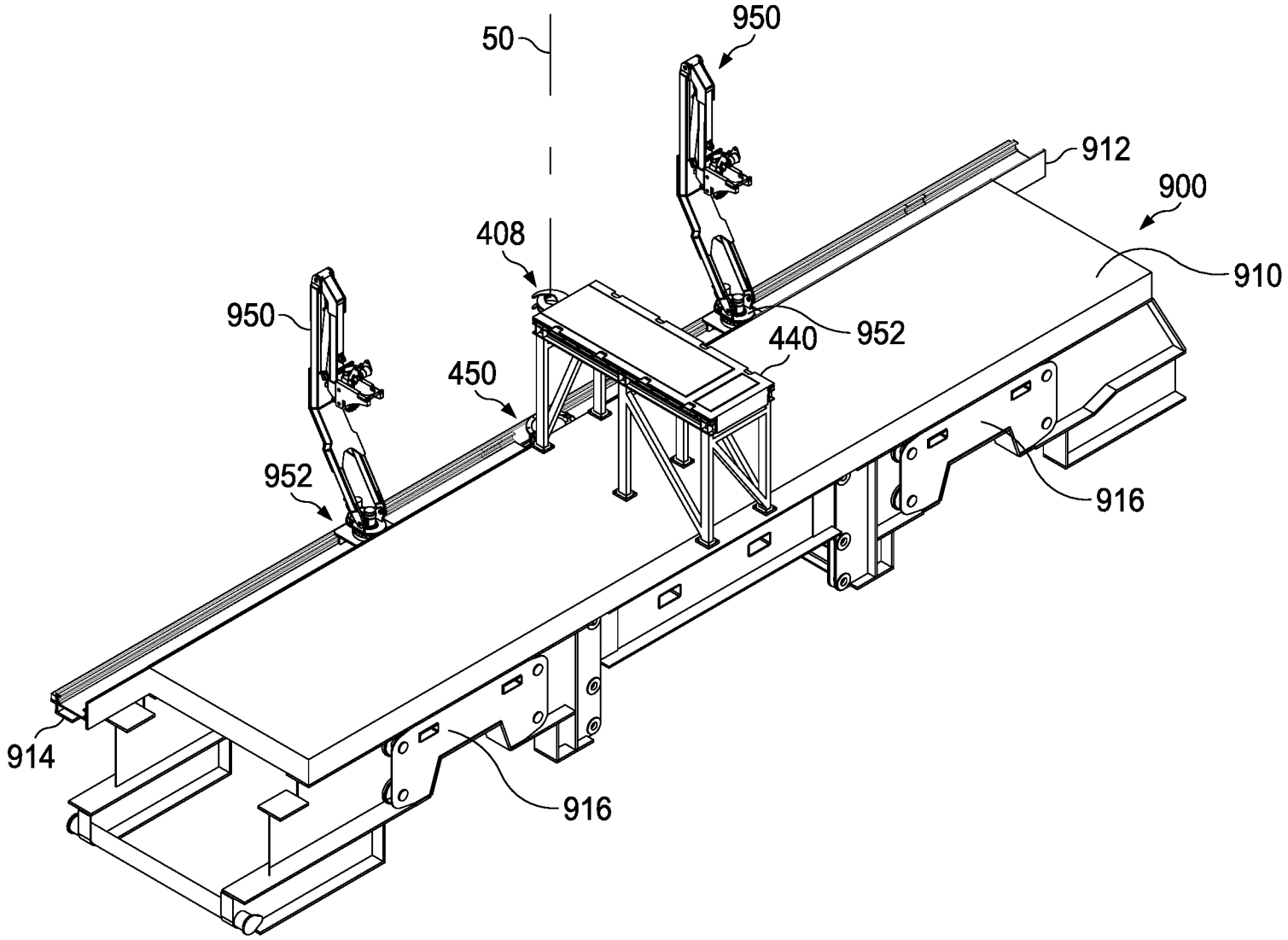
FIG. 34 is an isometric view of an embodiment of the setback platform of the tubular racking system of the disclosed embodiments.

FIG. 34 is an isometric view of an embodiment of setback platform 900 of the tubular racking system of the disclosed embodiments. Setback platform 900 comprises platform 910 for vertical storage of tubular stands 80 (not shown). Platform 910 has a mast side and an opposite catwalk side. An alleyway 912 extends along the mast side of platform 910. Alleyway 912 is offset below platform 910. Stand hand-off position 50 is located on alleyway 912. A geared rail 914 is affixed to alleyway 912. A lower racking arm 950 is provided, having a base 952 translatably connected to the rail 914.

Figure 35:
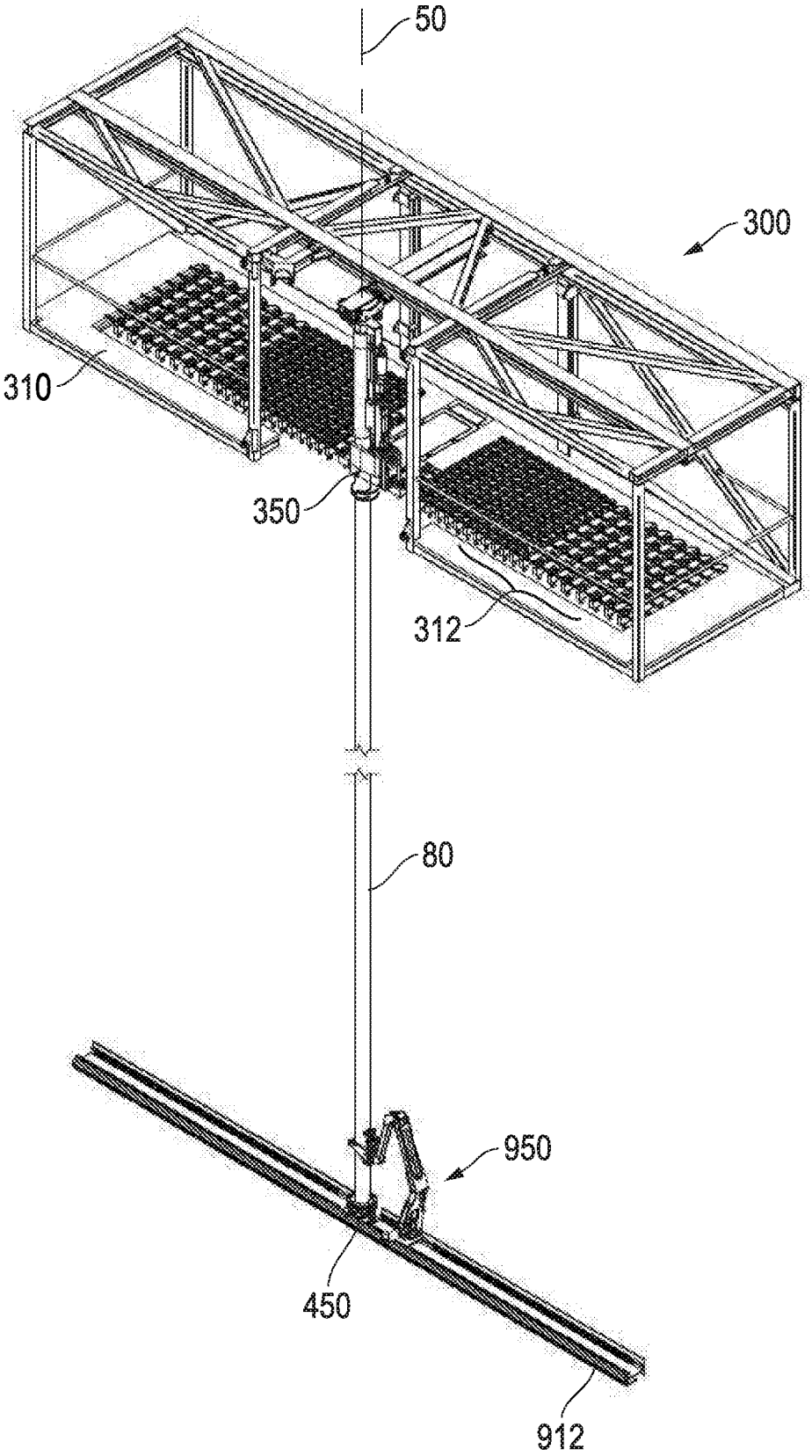
FIG. 35 is an isometric view of an upper racking module of the tubular racking system of the disclosed embodiments showing a tubular stand being held in the stand hand-off position by an upper stand constraint.

FIG. 35 is an isometric view of upper racking module 300 illustrating tubular stand 80 held at stand hand-off position 50 by upper stand constraint 420, and engaged by upper racking arm 350 and by lower racking arm 950. Optional engagement with lower stand constraint 440 is not shown. Like upper racking arm 350, lower racking arm 950 can rotate on the centerline of tubular stand 80. In this manner, lower racking arm 950 can follow upper racking arm 350 between stand hand-off position 50, and any racking position in racking module 300, while keeping tubular stand 80 vertical.

Figure 36:
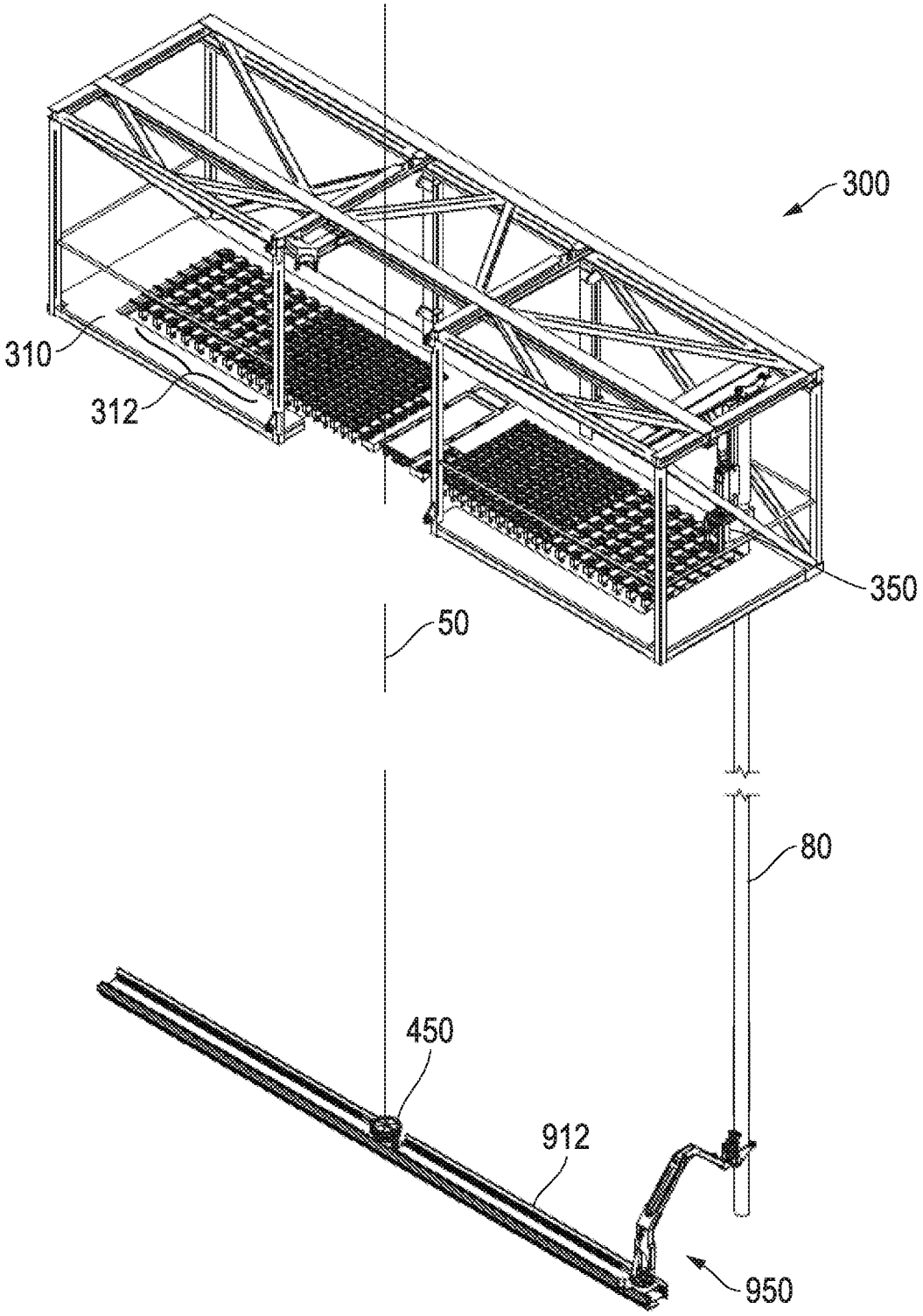
FIG. 36 is an isometric view of the embodiment of FIG. 35 the tubular stand secured vertically in the stand hand-off position by the upper and lower stand constraints.

FIG. 36 is an isometric view illustrating tubular stand 80 supported vertically by upper racking arm 350 and held at its lower end by lower racking arm 950, and extended to its designated racking position.

If used herein, the term "substantially" is intended for construction as meaning "more so than not."

Having thus described the disclosed embodiments by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the disclosed embodiments may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the disclosed embodiments.

The invention claimed is:

1. A method to insert in or remove tubular stands from a drill string below a drilling rig, comprising:

vertically translating a top drive assembly along a mast of the drilling rig;

translatably connecting to the mast a dolly of a tubular delivery arm, the tubular delivery arm comprising the dolly, an upper end of an arm member connected to the dolly, and a tubular clasp connected to a lower end of the arm member;

vertically translating the tubular delivery arm along the mast;

rotating and pivoting the upper end of the arm member with respect to the tubular delivery arm dolly to move the tubular clasp between a well center position over a well center and a second position forward of the well center position; and pivoting the tubular clasp with respect to the lower end of the arm member.

2. The method of claim 1, further comprising clasping an upper portion of a tubular stand with the tubular clasp to transport the tubular stand between well center position and the second position.

3. The method of claim 2, further comprising:

positioning the tubular clasp below an upper end of the tubular stand to secure the upper portion of the tubular stand in the well center position; and engaging or disengaging a top drive and the upper end of the tubular stand secured in the well center position.

4. The method of claim 2, wherein the second position comprises a stand hand-off position located on a mast side of a setback platform.

5. The method of claim 4, wherein the stand hand-off position extends vertically upwards substantially between the mast and a fingerboard assembly of a racking module.

6. The method of claim 5, further comprising positioning the tubular clasp over a mousehole in line between the well center and the stand hand-off position.

7. The method of claim 6, further comprising positioning the tubular clasp over a catwalk in line with the stand hand-off position and the mousehole.

8. The method of claim 5, further comprising securing the tubular stand in the stand hand-off position with a stand constraint.

9. The method of claim 8, further comprising connecting the stand constraint to the racking module, and extending the stand constraint to the stand hand-off position.

10. The method of claim 8, further comprising positioning the stand constraint on the setback platform, and centering the stand constraint over the stand hand-off position.

11. The method of claim 8, further comprising connecting an upper one of the stand constraints to the racking module;

extending the upper stand constraint to the stand hand-off position;

connecting a lower one of the stand constraints on the setback platform;

centering the lower stand constraint over the stand hand-off position;

engaging the upper and lower stand constraints with respective upper and lower portions of the tubular stand in the stand hand-off position to vertically orient the tubular stand; and setting the tubular stand down on the platform in the stand hand-off position.

12. The method of claim 8, further comprising affixing the stand constraint to the setback platform;

offsetting the setback platform beneath a drill floor and connecting the setback platform to a substructure of the drilling rig;

setting down the tubular stand on a surface of the setback platform in the hand stand-off position;

locating an alleyway on the setback platform that is accessible to the surface;

locating the stand hand-off position on the alleyway;

extending a constraint clasp over the stand hand-off position; and retracting the constraint clasp away from the substructure to remove the constraint clasp from intersection with the alleyway.

13. The method of claim 5, further comprising:

engaging the tubular clasp and an upset at an upper end of the tubular stand to transport the tubular stand between the stand hand-off and well center positions;

moving the tubular clasp to a position on the tubular stand below the upset to center the one tubular stand in the well center position; and engaging or disengaging the top drive and an upper end of the tubular stand centered in the well center position.

14. The method of claim 1, further comprising extending an arm bracket outwardly from the tubular delivery arm dolly, rotatably connecting a drive plate to the arm bracket, and pivotally connecting the upper end of the arm member to the drive plate.

15. The method of claim 14, further comprising operating a tilt actuator pivotally connected between the drive plate and the arm member to pivot the arm member.

16. The method of claim 14, further comprising operating an incline actuator pivotally connected between the arm member and the tubular clasp to pivot the tubular clasp.

17. The method of claim 1, further comprising:

vertically translating a top drive of the top drive assembly along a first path over the well center;

horizontally moving the top drive between the well center position and a retracted position rearward to a drawworks side of the well center position;

vertically translating the top drive in the retracted position along a second path.

18. The method of claim 17, further comprising translatably connecting a dolly of the top drive assembly to the mast;

suspending a top drive from a travelling block assembly of the top drive assembly;

pivotally connecting the travelling block to the top drive dolly with a yoke;

connecting an extendable actuator between the top drive dolly and the yoke;

extending the actuator to pivot the yoke to extend the travelling block and top drive away from the dolly to the well center position; and retracting the actuator to pivot the yoke to retract the travelling block towards the dolly to a position away from the well center.

19. The method of claim 18, further comprising rigidly connecting a torque tube to the travelling block;

connecting the torque tube to the top drive in vertically slidable relation; and transferring torque reactions of a drill string responding to rotation by the top drive from the top drive to the torque tube, from the torque tube to the travelling block, from the travelling block to the top drive dolly, and from the top drive dolly to the mast.

20. The method of claim 5, further comprising pivotally and rotatably connecting a lower stabilizing arm to the drilling rig;

connecting a tubular guide to the lower stabilizing arm; and moving the tubular guide between the stand hand-off position and the well center position.

21. The method of claim 5, further comprising moving a gripper of an upper racking arm over the fingerboard assembly and the stand hand-off position.

22. The method of claim 21, further comprising connecting a bridge of the upper racking arm to a frame of the racking module in translatable relation;

translating the bridge along the of the racking module frame;

connecting an upper racking arm member to the bridge in rotatable and translatable relation;

translating the upper racking arm member along the bridge;

connecting the gripper to the upper racking arm member in vertically translatable relation; and vertically translating the gripper.

23. The method of claim 21, further comprising connecting the racking module to the mast, wherein the racking module comprises a frame;

connecting the fingerboard assembly to the racking module frame, wherein the fingerboard has columns receivable of tubular stands;

orienting the columns in a direction towards the mast;

connecting the columns to a fingerboard alleyway on a mast side of the columns.

24. The method of claim 23, further comprising positioning the setback platform beneath the fingerboard assembly;

locating a platform alleyway beneath the fingerboard alleyway; and positioning a lower racking arm in the platform alleyway.

25. The method of claim 5, further comprising:

connecting or disconnecting the tubular stand and a drill string;

engaging or disengaging the tubular stand and the top drive assembly; and lowering or hoisting the tubular stand connected to the drill string with the top drive assembly.

26. The method of claim 1, further comprising:

moving a tubular stand between a racked position in a fingerboard assembly and a set down position in a stand hand-off position located between the fingerboard assembly and the mast;

retrieving and delivering the tubular stand between the stand hand-off position and the well center position;

connecting or disconnecting the tubular stand and the drill string;

engaging or disengaging the tubular stand and the top drive assembly; and lowering or hoisting the tubular stand connected to the drill string with the top drive assembly.

27. The method of claim 26, further comprising setting down the tubular stand in the stand hand-off and racked positions on a setback platform.

28. The method of claim 27, further comprising securing and releasing the tubular stand set down in the stand hand-off position.

29. The method of claim 28, wherein securing the tubular stand in the stand hand-off position comprises constraining upper and lower portions of the tubular stand to secure the tubular stand in vertical orientation.

30. The method of claim 26, wherein the movement of the tubular stand between the racked position and the stand hand-off position comprises guiding an upper portion of the tubular stand through columns of the fingerboard assembly oriented toward the mast and through a transverse alleyway on a mast side of the fingerboard assembly connecting the columns to the stand hand-off position.

31. The method of claim 30, further comprising guiding a lower portion of the tubular stand along a path coincident with the movement of the upper portion of the tubular stand between the fingerboard assembly and the stand hand-off position.

32. The method of claim 5, further comprising:

operating an upper racking arm to guide an upper portion of the tubular stand between the fingerboard assembly and the stand hand-off position;

operating the tubular delivery arm independently of the upper racking arm to guide the upper portion of the tubular stand for retrieval and delivery between the stand hand-off position and the well center position; and using the stand hand-off position as a designated set down position to hand off the upper portion of the tubular stand between the upper racking arm and the tubular delivery arm.

33. The method of claim 32, further comprising returning the upper racking arm free of the guided tubular stand into position for the guiding of another tubular stand.

34. The method of claim 32, further comprising returning the tubular delivery arm free of the delivered tubular stand into position for the retrieval of another tubular stand.

35. The method of claim 5 to insert tubulars in the drill string, comprising:

(a) moving the upper racking arm over one of a plurality of the tubular stands racked in the fingerboard assembly;

(b) engaging and hoisting an upper portion of the one tubular stand with an upper racking arm;

(c) moving the upper racking arm over the fingerboard assembly to position the one tubular stand in the stand hand-off position;

(d) setting down the one tubular stand in the stand hand-off position;

(e) securing the one tubular stand in the stand hand-off position;

(f) disengaging and moving the upper racking arm over the fingerboard assembly away from the stand hand-off position; and (g) repeating (a) to (f) for a next one of the tubular stands.

36. The method of claim 5 to insert tubulars in the drill string, comprising:

(1) engaging the tubular clasp with an upper end of a tubular stand secured in the stand hand-off position;

(2) releasing the tubular stand secured in the stand hand-off position;

(3) translating the tubular delivery arm along the mast to hoist the tubular stand;

(4) retracting the tubular delivery arm to move the tubular stand away from the stand hand-off position;

(5) rotating the tubular delivery arm to face the well center position;

(6) extending the tubular delivery arm to move the tubular stand into the well center position;

(7) connecting the tubular stand to the drill string;

(8) releasing the tubular stand from the tubular clasp and retracting, rotating, extending, and translating the tubular delivery arm along the mast to return the tubular clasp to the upper portion of another tubular stand secured in the stand hand-off position; and (9) repeating (1) to (8) for another tubular stand.

37. The method of claim 36, further comprising

(10) after the connection in (7), translating the tubular delivery arm downward along the mast to move down the tubular clasp engaging the upper portion of the tubular stand;

(11) translating the top drive assembly in a retracted position along the mast past the tubular delivery arm to the upper portion of the tubular stand above the tubular clasp;

(12) engaging the top drive and the upper portion of the tubular stand while clasping the upper portion of the tubular stand with the tubular clasp below the top drive assembly;

(13) translating the top drive assembly along the mast to lower the tubular stand and drill string into the well;

(14) disengaging the top drive assembly from the tubular stand;

(15) retracting the top drive assembly from the well center position; and

(16) repeating (10) to (15) for another tubular stand.

38. The method of claim 5 to remove tubulars from the drill string, comprising:

(1) engaging a clasp of an extended tubular delivery arm with an upper portion of one of the tubular stands connected to the drill string engaged in slips;

(2) disconnecting the one tubular stand from the drill string;

(3) retracting the tubular delivery arm to move the one tubular stand away from the well center position;

(4) translating the tubular delivery arm along the mast to lower the one tubular stand;

(5) rotating the tubular delivery arm to face the stand hand-off position;

(6) extending the tubular delivery arm to move the one tubular stand into the stand hand-off position;

(7) securing the one tubular stand in the stand hand-off position;

(8) releasing the one tubular stand from the tubular clasp and retracting, rotating, extending, and translating the tubular delivery arm along the mast to return the clasp to the upper portion of a next one of the tubular stands connected to the drill string engaged in the slips; and (9) repeating (1) to (8) for the next one tubular stand.

39. The method of claim 38, further comprising

(10) engaging the top drive assembly and the upper portion of the one tubular stand connected to the drill string;

(11) translating the top drive assembly along the mast to hoist the one tubular stand and connected drill string;

(12) clasping the upper portion of the tubular stand with the tubular clasp of the tubular delivery arm below the top drive assembly;

(13) disengaging the top drive assembly from the tubular stand;

(14) translating the tubular delivery arm along the mast to raise the tubular clasp at the upper portion of the one tubular stand in the well center position for the engagement in (1);

(15) retracting and translating the top drive assembly along the mast past the tubular delivery arm; and

(16) repeating (10) to (15) for a next one of the tubular stands.

40. The method of claim 5 to remove tubulars from the drill string, comprising:

(a) moving an upper racking arm over the tubular stand secured in the stand hand-off position;

(b) engaging and hoisting an upper portion of the tubular stand with the upper racking arm;

(c) releasing the tubular stand from the stand hand-off position;

(d) moving the upper racking arm over the fingerboard assembly to position the tubular stand in a racked position;

(e) setting down the tubular stand in the racked position;

(f) disengaging and moving the upper racking arm over the fingerboard assembly away from the tubular stand racked in the fingerboard assembly; and (g) repeating (a) to (f) for another tubular stand.

* * * * *